US011131050B2

(12) United States Patent
Sakata et al.

(10) Patent No.: US 11,131,050 B2
(45) Date of Patent: Sep. 28, 2021

(54) CONTROL METHOD OF CONTROLLING WASHING MACHINE, CONTROL DEVICE, AND NON-TRANSITORY RECORDING MEDIUM IN WHICH PROGRAM FOR CONTROLLING WASHING MACHINE IS RECORDED

(71) Applicant: Panasonic Intellectual Property Management Co., Ltd., Osaka (JP)

(72) Inventors: Yu Sakata, Osaka (JP); Kazuki Sakamoto, Shiga (JP); Takayuki Nishikawa, Osaka (JP)

(73) Assignee: PANASONIC INTELLECTUAL PROPERTY MANAGEMENT CO., LTD., Osaka (JP)

( * ) Notice: Subject to any disclaimer, the term of this patent is extended or adjusted under 35 U.S.C. 154(b) by 242 days.

(21) Appl. No.: 16/259,098

(22) Filed: Jan. 28, 2019

(65) Prior Publication Data

US 2019/0276967 A1 Sep. 12, 2019

(30) Foreign Application Priority Data

Mar. 7, 2018 (JP) ..... JP2018-040664

(51) Int. Cl.
*D06F 33/48* (2020.01)
*D06F 37/20* (2006.01)
(Continued)

(52) U.S. Cl.
CPC ..... *D06F 37/203* (2013.01); *D06F 33/00* (2013.01); *D06F 33/48* (2020.02); *D06F 35/007* (2013.01)

(58) Field of Classification Search
CPC .... D06F 18/00; D06F 33/00; D06F 33/30–76; D06F 34/00–34;
(Continued)

(56) References Cited

U.S. PATENT DOCUMENTS

2001/0042391 A1* 11/2001 Wobkemeier ..... D06F 34/28 68/12.02
2012/0073062 A1* 3/2012 Farid ..... D06F 37/225 8/137

FOREIGN PATENT DOCUMENTS

CN 102234901 11/2011
JP 2009-100985 5/2009
(Continued)

*Primary Examiner* — David G Cormier
(74) *Attorney, Agent, or Firm* — Wenderoth, Lind & Ponack, L.L.P.

(57) ABSTRACT

Present application discloses control method of controlling operation mode of washing machine by communication with washing machine. Control method includes obtaining vibration information indicative of vibration of washing tub of washing machine operating in predetermined first operation mode as operation mode; extracting predetermined feature amount having correlation with strength of floor on which washing machine is placed from vibration information; estimating strength of floor from extracted feature amount; determining whether or not operation mode needs to be changed from first operation mode based on estimated strength; and when determination is made that operation mode needs to be changed from first operation mode, outputting, to washing machine, instruction to change operation mode from first operation mode to second operation mode different from first operation mode.

12 Claims, 13 Drawing Sheets

(51) Int. Cl.
*D06F 35/00* (2006.01)
*D06F 33/00* (2020.01)

(58) Field of Classification Search
CPC ..... D06F 35/00–008; D06F 37/00; D06F 37/203; D06F 37/22; D06F 37/225; D06F 37/24; D06F 37/245; D06F 37/42; D06F 39/00; D06F 58/00; D06F 58/02; D06F 58/04; D06F 58/20; D06F 58/203; D06F 58/30; D06F 58/32–52; D06F 2101/00–20; D06F 2103/00–70; D06F 2105/00–62; D06F 2202/00; D06F 2202/10; D06F 2202/12; D06F 2204/00–10; D06F 2204/06; D06F 2204/065; D06F 2210/00; D06F 2212/00; D06F 2212/02; D06F 2212/04; D06F 2212/06; D06F 2214/00; D06F 2216/00; D06F 2220/00; D06F 2222/00; D06F 2224/00; D06F 2226/00
See application file for complete search history.

(56) References Cited

FOREIGN PATENT DOCUMENTS

| | | |
|---|---|---|
| JP | 2010-035953 | 2/2010 |
| JP | 2013-132500 | 7/2013 |
| JP | 2017-215157 | 12/2017 |
| KR | 10-2010-0038702 | 4/2010 |

* cited by examiner (CONFIRMATION IMAGE)

(CONFIRMATION IMAGE)

(CONFIRMATION IMAGE)

FIG. 11

| | | ESTIMATION | | |
|---|---|---|---|---|
| | | PLACEMENT CONDITION 1 | PLACEMENT CONDITION 2 | PLACEMENT CONDITION 3 |
| ACTUAL | PLACEMENT CONDITION 1 | 10 | 0 | 0 |
| | PLACEMENT CONDITION 2 | 0 | 10 | 0 |
| | PLACEMENT CONDITION 3 | 0 | 2 | 8 |

CORRECT INCORRECT

CONTROL METHOD OF CONTROLLING WASHING MACHINE, CONTROL DEVICE, AND NON-TRANSITORY RECORDING MEDIUM IN WHICH PROGRAM FOR CONTROLLING WASHING MACHINE IS RECORDED

TECHNICAL FIELD

The present invention relates to techniques for reducing vibrations of a floor on which a washing machine is placed.

BACKGROUND ART

A washing machine is generally equipped with a washing tub in which laundry is stored. When the washing tub rotates around a predetermined rotation axis, large vibrations may be resultant from resonance between the washing machine and a floor on which the washing machine is placed. The large vibrations may make a user feel uncomfortable.

JP 2010-35953 A discloses techniques for reducing large vibrations resultant from resonance between a floor and a washing machine under adjustment to a rotation speed of a washing tub on the basis of vibration data output from a vibration sensor which is attached to a housing of the washing machine. The reduction in large vibrations alleviates user's unpleasantness.

According to JP 2010-35953 A, a vibration sensor is also attached to the washing tub in addition to the housing. The vibration sensor attached to the washing tub is used in many typical washing machines in order to determine whether laundry is unevenly present in the washing tub. On the other hand, the vibration sensor attached to the housing is mainly used for detecting vibrations of the washing machine. Therefore, a washing machine without a function of detecting resonance between the washing machine and a floor on which the washing machine is placed does not have a vibration sensor attached to a housing. In short, the techniques disclosed in JP 2010-35953 A need an additional vibration sensor for detecting vibrations of the washing machine. The addition of the vibration sensor results in an increase in manufacturing costs and power consumption of the washing machine.

SUMMARY OF INVENTION

An object of the present invention is to provide techniques of reducing vibrations under operation of a washing machine without an additional vibration sensor.

A control method according to one aspect of the present invention is used for controlling an operation mode of a washing machine under communication with the washing machine. The control method includes obtaining vibration information indicative of vibrations of a washing tub of the washing machine operating under a predetermined first operation mode as the operation mode; extracting a predetermined feature amount from the vibration information, the feature amount having correlation with a strength of a floor on, which the washing machine is placed; estimating the strength of the floor based on the extracted feature amount; determining it based on the estimated strength whether the operation mode has to be changed from the first operation mode; and outputting an instruction to the washing machine when it is determined that the operation mode has to be changed from the first operation mode, in order to change the operation mode from the first operation mode to a second operation mode different from the first operation mode.

A control device according to another aspect of the present invention controls an operation mode of a washing machine under communication with the washing machine. The control device includes an acquisition portion configured to obtain vibration information indicative of vibrations of a washing tub of the washing machine operating under a predetermined first operation mode as the operation mode; an extractor configured to extract a predetermined feature amount from the vibration information, the feature amount having correlation with a strength of a floor on which the washing machine is placed; an estimation portion configured to estimate the strength of the floor based on the extracted feature amount; a determination portion configured to determine it based on the estimated strength whether the operation mode has to be changed from the first operation mode; and an output portion configured to output an instruction to the washing machine when it is determined that the operation mode has to be changed from the first operation mode, in order to change the operation mode from the first operation mode to a second operation mode different from the first operation mode.

A non-transitory recording medium according to yet another aspect of the present invention is used for recording a program causing a computer to operate as a control device, the control device configured to control an operation mode of a washing machine under communication with the washing machine. The program causes the computer to (i) obtain vibration information indicative of vibrations of the washing machine operating under a predetermined first operation mode as the operation mode; (ii) extract a predetermined feature amount from the vibration information, the feature amount having correlation with a strength of a floor on which the washing machine is placed; (iii) estimate the strength of the floor based on the extracted feature amount; (iv) determine it based on the estimated strength whether the operation mode has to be changed from the first operation mode; and (v) output an instruction to the washing machine when it is determined that the operation mode has to be changed from the first operation mode, in order to change the operation mode from the first operation mode to a second operation mode different from the first operation mode.

The aforementioned technique enables a reduction in vibrations resultant from operation of a washing machine without an additional vibration sensor.

An object, features and effects of the aforementioned control technique will become apparent from the following detailed description and accompanying drawings.

BRIEF DESCRIPTION OF DRAWINGS

FIG. 11 shows an estimation result obtained from a correlation model.

DESCRIPTION OF EMBODIMENTS

<Washing Machine to be Controlled>

Figure 2:
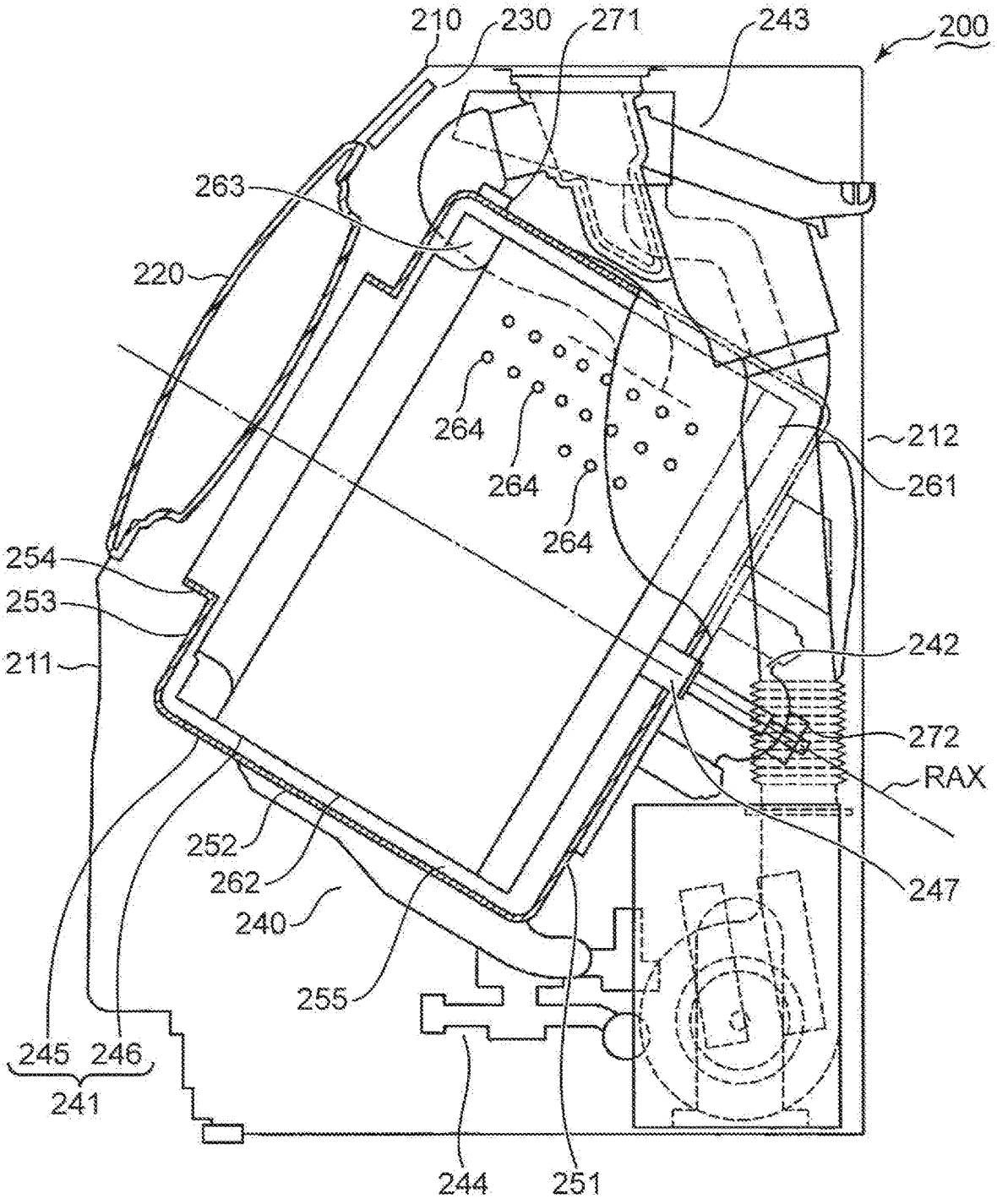
FIG. 2 is a schematic sectional view of an exemplary washing machine to be controlled.

FIG. 2 is a schematic sectional view of an exemplary washing machine 200 to be controlled. The washing machine 200 is described with reference to FIG. 2.

The washing machine 200 includes a housing 210, a door 220 which closes an opening formed on an outer surface of the housing 210, an input interface 230 situated above the door 220, and a washing mechanism 240 situated in the housing 210. The housing 240 includes a front surface 211 and a rear surface 212 opposite to the front surface 211. Directional terms such as "front" and "rear" are used below to match the terms used for the housing 210. These directions are for clarification of description only, and are not to be construed limitative.

The door 220 and the input interface 230 are situated on the front surface 211 of the housing 210. The door 220 and the input interface 230 are operated by a user. The user opens the door 220 to put laundry into the washing mechanism 240 or take the laundry from the washing mechanism 240. While the washing mechanism 240 washes the laundry, the door 220 is closed. Accordingly, water used for washing the laundry does not spill from the housing 210. Before the laundry is washed, the user may operate the input interface 230 to actuate or stop the washing mechanism 240, or change a setting about washing operation of the washing mechanism 240. The input interface 230 may additionally have a function of displaying an operation state of the washing machine 200. The input interface 230 may be a touch panel. Alternatively or additionally, the input interface 230 may include an operational portion such as a press button or a dial.

The washing mechanism 240 washes the laundry according to the setting input through the input interface 230. The washing mechanism 240 includes a washing tub 241, a motor 242 situated behind the washing tub 241, a watering portion 243 situated above the washing tub 241, and a draining portion 244 situated below the washing tub 241. The washing tub 241 conducts rotational movement under operation of the motor 242 to wash and spin-dry laundry. The watering portion 243 supplies the washing tub 241 with water for washing the laundry. The draining portion 244 drains water which has been used for washing the laundry or water removed from the laundry outside the housing 210.

The washing tub 241 situated in the housing 210 includes, a generally cylindrical outer tub 245, and a drum 246 situated in the outer tub 245. The outer tub 245 and the drum 246 are opened to the door 220 at the closed position. When the door 220 is opened by a user, the user may put laundry into the drum 246 or take the laundry from the drum 246. The outer tub 245 is formed so as to surround substantially the entire drum 246. The outer tub 245 is suspended in the housing 210 by a suspension mechanism (not shown) situated in the housing 210.

The outer tub 245 includes a generally disk-shaped bottom wall 251, a circumferential wall 252 forming a cylinder extending forward from an outer circumferential edge of the bottom wall 251, a front wall 253 forming an annular wall portion which bends inwardly from the front edge of the circumferential wall 252, and a generally cylindrical protruding wall 254 which protrudes forward from the inner circumferential edge of the front wall 253. The motor 242 is attached to the bottom wall 251. The bottom wall 251 is generally orthogonal to the rotation axis RAX of the motor 242. The rotation axis RAX of the motor 242 is indicated by a chain line inclined upward and forward in FIG. 2. The circumferential wall 252 of which central axis is substantially coincident with the rotation axis RAX forms a storage space 255 in which water is stored in cooperation with the bottom and front walls 251, 253. The watering portion 243 and the draining portion 244 are coupled with the circumferential wall 252. Water supplied from the watering portion 243 is temporarily stored in the storage space 255 and used for washing the laundry in the drum 246. After the washing, the water used for the washing is drained from the storage space 255 outside the housing 210 through the draining portion 244. The protruding wall 254 in front of the storage space 255 protrudes forward from the front wall 253. The front edge of the protruding wall 254 is pressed against the inner surface of the door 220 at the closed position to form a sealed structure which prevents leakage of water from the storage space 255.

The drum 246 situated in the storage space 255 includes a generally disk-shaped bottom wall 261, a circumferential wall 262 forming a cylinder extending forward from the outer circumferential edge of the bottom wall 261, and a front wall 263 forming an annular wall portion bending inwardly from the front edge of the circumferential wall 262. The bottom wall 261 receives a rotational force from the motor 242 to rotate around the rotation axis RAX. The circumferential and front walls 262, 263 continuous with the bottom wall 261 also rotate under the operation of the motor 242. Many through holes 264 are formed in the circumferential wall 262. Water in the storage space 255 flows into the drum 246 through these through holes 264. Additionally, water removed from laundry in a spin-drying step after the washing is drained outside the drum 246 through these through holes 264. An opening region formed by the front wall 263 at the front end of the circumferential wall 262 in which the many through holes 264 are formed is larger than an opening region formed by the protruding wall 254 of the outer tub 245. Accordingly, the front wall 263 of the drum 246 does not obstruct laundry from being put in or being taken out from the washing tub 241.

The motor 242 configured to drive the washing tub 241 includes a shaft 247 bi-directionally rotating around the rotation axis RAX. The shaft 247 extends through the bottom wall 251 of the outer tub 245 and is coupled with the bottom wall 261 of the drum 246. Accordingly, a rotational force of the motor 242 is transmitted to the drum 246.

The watering portion 243 configured to supply water to the washing tub 241 which is driven by the motor 242 includes a tubular member forming a flow path of water and valves attached to the tubular member. The tubular member of the watering portion 243 may form a flow path passing through a detergent storage portion (not shown) in which detergent is stored and another flow path which does not pass through the detergent storage portion. One of the valves of the watering portion 243 opens or closes a water supply path to the washing tub 241. The other of the valves of the watering portion 243 is used for selecting the flow path passing through the detergent storage portion or the flow path which does not pass through the detergent storage portion. These valves operate at timings designated by a predetermined operation program which sets operation of the washing tub 241.

Water supplied to the washing tub 241 through the watering portion 243 is drained outside the housing 210 through the draining portion 244. The draining portion 244 includes a tubular member forming a water flow path, a filter which removes foreign matters from water flowing through the tubular member, and a valve which opens or closes the flow path formed by the tubular member. Like the valves of the watering portion 243, the valve of the draining portion 244 operates at timings designated by the predetermined operation program which sets the operation of the washing tub 241.

Schematic operation of the washing machine 200 is described below.

A user opens the door 220 to put laundry into the drum 246. The user then closes the door 220 to cause the washing machine 200 to execute a predetermined operation program. The washing machine 200 sequentially executes a washing step, a rinsing step, a spin-drying step and a drying step according to the operation program. These steps are schematically described below.

In the washing step, the watering portion 243 supplies water to the storage space 255. At least a part of the water supplied to the storage space 255 passes through the detergent storage portion and is supplied, to the storage space 255 together with detergent. The motor 242 then works to rotate the drum 246 around the rotation axis RAX. Accordingly, the laundry in the drum 246 is moved upward by the circumferential wall 262 of the drum 246, and then falls down from above (i.e. beat wash). Accordingly, the laundry is effectively cleaned.

After the laundry is washed, the rinsing step is executed. In the rinsing step, the watering portion 243 supplies water to the storage space 255 without making the water pass through the detergent storage portion. The laundry in the storage space 255 is stirred under rotation of the drum 246 to remove the detergent from the laundry. In the rinsing step, water supply through the watering portion 243 and water drainage through the draining portion 244 are repeated to remove most of the detergent adhered to the laundry.

The laundry after the removal of the detergent is subjected to the spin-drying step. In the spin-drying step, the motor 242 rotates the drum 246 at a high speed. Accordingly, water impregnated in the laundry is centrifugally separated.

After spin-drying the laundry, the drying step is executed. In the drying step, a drying mechanism situated in the housing 210 is actuated. The drying mechanism sends hot dry air into the storage space 255 to dry the laundry in the drum 246. During the drying step, the laundry is stirred under a rotation of the drum 246 and evenly exposed to the hot dry air. After the drying step, the user may open the door 220 to take out the dried laundry from the washing tub 241.

During a series of steps of washing (i.e. the washing step, the rinsing step, the spin-drying step and the drying step) described above, the laundry may be unevenly present in the drum 246. The unevenly present laundry causes an exciting force to vibrate the washing tub 241. The motor 242 rotating the drum 246 of the washing tub 241 also functions as a vibration source. The vibrations caused by these vibration sources are transmitted to a floor through the housing 210, the washing machine 200 being placed on the floor. When a rotational frequency of the drum 246 is close, to a resonance frequency determined by the floor on which the washing machine 200 is placed and a house structure surrounding the washing machine 200, the user feels large vibrations. A control device 100 controls an operation mode of the washing machine 200 under communication with the washing machine 200 so as to reduce the large vibrations resultant from the washing machine 200 and the floor on which the washing machine 200 is placed. The control of the washing machine 200 is described below.

<Control of Washing Machine>

Figure 1:
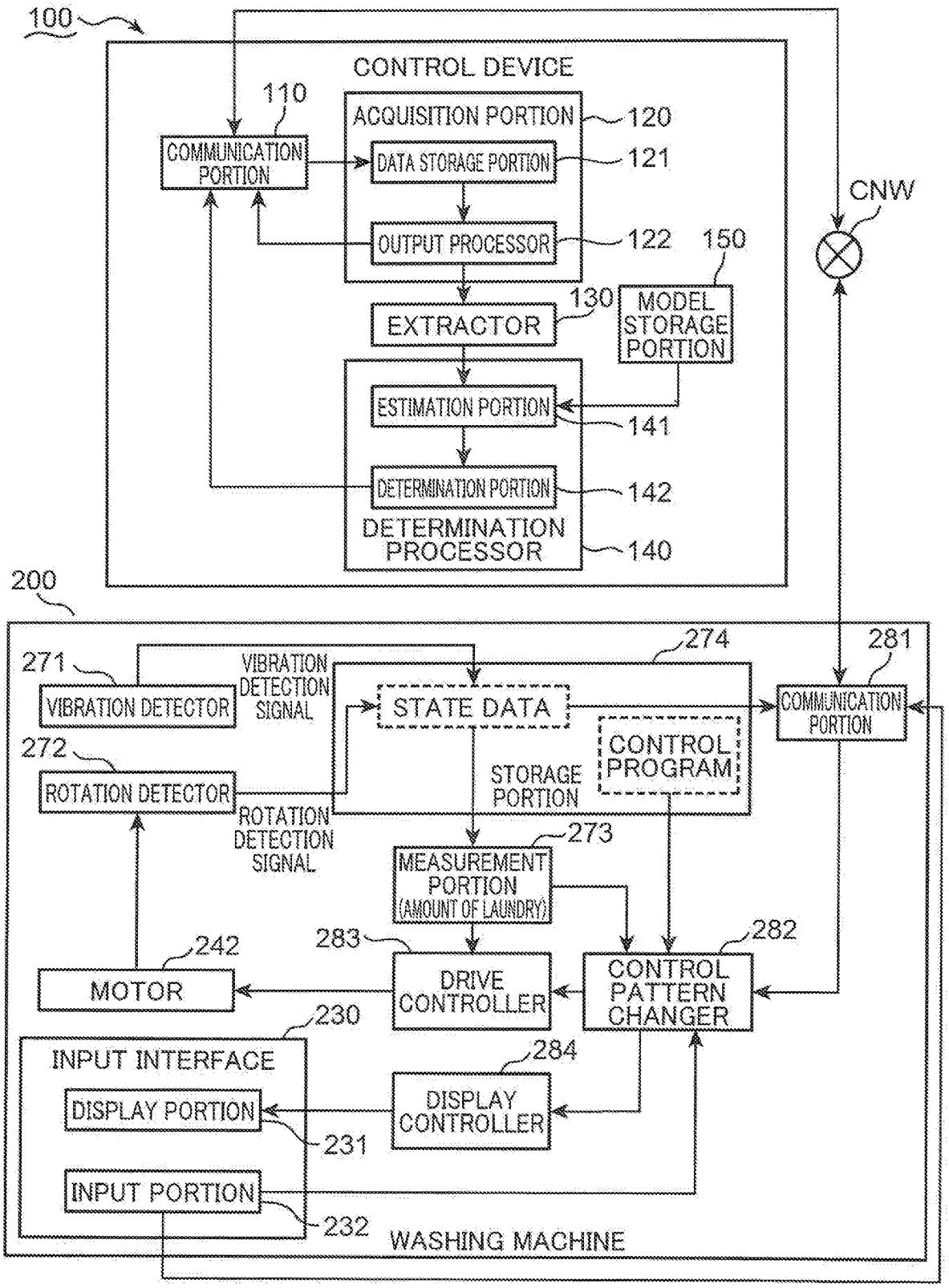
FIG. 1 is a schematic block diagram showing an exemplary functional configuration of a control device which controls a washing machine.

FIG. 1 is a schematic block diagram showing an exemplary functional configuration of the control device 100 which controls the washing machine 200. The control of the washing machine 200 is described with reference to FIGS. 1 and 2.

The washing machine 200 and the control device 100 are formed to be communicable. The control device 100 communicates with the washing machine 200 to obtain state data indicative of a state of the washing machine 200. The control device 100 controls the washing machine 200 on the basis of the state data. In addition to the control device 100. FIG. 1 shows a part for obtaining the state data indicative of a state of the washing machine 200, a part operable under the control of the control device 100, and a part communicating with the control device 100 as a functional configuration of the washing machine 200. These parts are described below before description of the control device 100.

The washing machine 200 includes a vibration detector 271, a rotation detector 272, a measurement portion 273 and a storage portion 274 as parts for obtaining the state data. The vibration detector 271 may be a vibration sensor attached to an upper portion of the circumferential wall 252 of the outer tub 245 (c.f. FIG. 2). The rotation detector 272 functions as, an ampere meter which measures an amount of current (hereinafter, referred to as "torque current value") generated when the motor 242 rotates. The measurement portion 273 may be an operation device configured to convert a torque current value to an amount of laundry put in the washing tub 241 (hereinafter, referred to as "an amount of laundry"). The storage portion 274 may be a memory which stores vibration in and the torque current, value (i.e. the state data) obtained from the vibration detector 271 and the rotation detector 272. These elements are described below.

The vibration sensor used as the vibration detector 271 is attached near the front end of the circumferential wall 252 as shown in FIG. 1. The vibration sensor generates a vibration detection signal indicative of vibration accelerations in three axis directions orthogonal to one another. The vibration detection signal is output from the vibration detector 271 to the storage portion 274. The storage portion 274 stores the vibration information indicated by the vibration detection signal as a part of the state data.

The storage portion 274 receives not only the vibration detection signal but also a rotation detection signal generated by the rotation detector 272. The rotation detector 272 is attached to the motor 242 to generate a rotation detection signal indicative of a torque current value of the motor 242. The torque current value is stored in the storage portion 274 as a part of the state data. The rotation detector 272 may include a position detection element which detects a position of a rotor of the motor 242 in addition to an ampere meter which measures a torque current value. Data about a position of the rotor detected by the position detection element may be used for feedback control of the motor 242.

Current data indicative of the torque current value of the motor 242 is read from the storage portion 274 by the measurement portion 273. The measurement portion 273 measures an amount of laundry on the basis of the torque current value. When the torque current value is large, the measurement portion 273 calculates a large amount of laundry on the basis of a predetermined conversion formula. On the other hand, when the torque current value is small, the measurement portion 273 calculates a small amount of laundry on the basis of the predetermined conversion formula. The rotation of the motor 242 is adjusted on the basis of the calculated amount of laundry.

Not only the current data indicative of the torque current value and the vibration information indicative of vibrations of the washing tub 241 but also control programs which set change patterns of the rotation of the motor 242 are stored in the storage portion 274. One of the control programs is selected under control of the control device 100 configured to communicate with the washing machine 200, so that the washing machine 200 operates on the basis of the selected control program. A part communicating with the control device 100 and a part operating under control of the control device 100 are described below.

FIG. 1 shows a communication portion 281 as the part communicating with the control device 100. The communication portion 281 may be a common communication module designed to communicate among apparatuses. Upon completion of execution of the control program, the communication portion 281 transmits the state data stored in the storage portion 274 to the control device 100 through a communication network CNW. The control device 100 refers to the state data to conduct a predetermined determination process and generate a control instruction on the basis of a determination result. The control instruction is transmitted from the control device 100 to the communication portion 281 of the washing machine 200. The washing machine 200 operates on the basis of the control instruction received by the communication portion 281.

The washing machine 200 includes the aforementioned motor 242 and the input interface 230 as parts operable under control of the control device 100. In addition, the washing machine 200 includes a control pattern changer 282, a drive controller 283 and a display controller 284. The control pattern changer 282 selects one of the control programs stored in the storage portion 274 on the basis of a control instruction. The selected control program is output from the control pattern changer 282 to the drive controller 283. The drive controller 283 determines a rotation speed of the motor 242 on the basis of the control program selected by the control pattern changer 282 and an amount of laundry measured by the measurement portion 273. The motor 242 rotates at the determined rotation speed.

The display controller 284 is also subjected to control of the control pattern changer 282 together with the drive controller 283 which determines a rotation speed of the motor 242. When the control pattern changer 282 changes one of the control programs to another, the display controller 284 controls the input interface 230 so that it is displayed in the input interface 230 that the control program has been changed.

The input interface 230 includes a display portion 231 and an input portion 232. The display portion 231 displays various images (character strings, icons and other images) under control of the display controller 284. When the control pattern changer 282 changes one of the control programs to another as described above, the display portion 231 displays an image under control of the display controller 284, the image indicating that the control program has been changed. The display portion 231 may also display an image for confirming user's acceptance or refusal of a change of a control program before the control program is changed. The user may operate the input portion 232 to input determination indicative of the acceptance or the refusal of a change of a control program to the washing machine 200. User's determination is output from the input portion 232 to the control pattern changer 282. The control pattern changer 282 changes, a control program only when the user accepts a change of a control pattern.

The input portion 232 is used not only for inputting the acceptance or the refusal of a change of a control pattern but also for inputting a determination request for requesting the determination process to the control device 100. The determination request is output from the input portion 232 to the communication portion 281. The communication portion 281 transmits information indicative of presence or absence of the determination request together with the state data.

Exemplary contents of the transmission data to be transmitted from the communication portion 281 to the control device 100 are shown in "Table 1" below.

TABLE 1

| Transmission data | | | | | |
|---|---|---|---|---|---|
| State data (storage portion) | | | | | Determination request (input portion) |
| Time | Acceleration A (first axis) | Acceleration B (second axis) | Acceleration C (third axis) | Torque current value | |
| 0.0 | −20 | 100 | 40 | 10000 | ON or OFF |
| 0.1 | −22 | 98 | 46 | 12000 | ON or OFF |
| . | . | . | . | . | . |
| . | . | . | . | . | . |
| . | . | . | . | . | . |

The data shown in the fields of "acceleration A", "acceleration B" and "acceleration C" in "Table 1" are vibration information obtained from the vibration detector 271. The data shown in the field of "acceleration A" represents vibration accelerations in a direction along a predetermined first axis. The data shown in the field of "acceleration B" represents vibration accelerations in a direction along a second axis orthogonal to the first axis. The data shown in the field of "acceleration C" represents vibration accelerations in a direction along a third axis orthogonal to the first and second axes. The data shown in the field of "torque current value" in "Table 1" is obtained from the rotation detector 272. The pieces of data shown in these fields are stored in the storage portion 274 together with time. In "Table 1", "0.0" shown in the field of "time" represents operation start time of the washing machine 200. Other values in the field of "time" represent elapsed times from the operation start time. Accordingly, the information data shown in "Table 1" is log information in which vibration accelerations and torque current values are recorded accumulatively in time series.

The field of "determination request" in "Table 1" represents whether a user operates the input portion 232 to request that the control device 100 executes the predetermined determination process. "ON" in the field of "determination request" represents that the user requests the determination process of the control device 100. "OFF" in the field of "determination request" represents that the user does not request the determination process of the control device 100.

The control device 100 conducts the determination process on the basis of the transmission data shown in "Table 1". An exemplary functional configuration of the control device 100 for conducting the determination process is described below.

The control device 100 includes a communication portion 110, an acquisition portion 120, an extractor 130, a determination processor 140 and a model storage portion 150. The communication portion 110 is a communication module functioning not only as an input portion which receives the transmission data of "Table 1" but also an output portion which outputs a control instruction obtained as a result of the determination process of the control device 100. The acquisition portion 120 stores the transmission data and also determines whether the stored transmission data is to be output to the extractor 130. The extractor 130 extracts a predetermined feature amount from the transmission data output by the acquisition portion 120. The determination processor 140 conducts a predetermined determination process on the basis of a feature amount extracted by the extractor 130 and a correlation model stored in the model storage portion 150, and also generates a control instruction for a reduction in vibrations of the washing machine 200. These elements are described below.

When the communication portion 281 of the washing machine 200 transmits the transmission data shown in "Table 1", the communication portion 110 of the control device 100 receives the transmission data. The transmission data is then output from the communication portion 110 to the acquisition portion 120.

The acquisition portion 120 includes a data storage portion 121 and an output processor 122. The data storage portion 121 stores the transmission data received by the communication portion 110. When the transmission data is stored, it is notified from the data storage portion 121 to the output processor 122 that the data storage portion 121 has received the transmission data from the washing machine 200. The output processor 122 after the reception of the notification from the data storage portion 121 refers to the field of "determination request" in the field of the transmission data (c.f. FIG. 1). When data in the field of "determination request" is "OFF", the output processor 122 does not output the transmission data to the extractor 130. When data in the field, of "determination request" is "ON", the output processor 122 outputs the transmission data to the extractor 130.

The extractor 130 extracts a predetermined feature amount from the transmission data. An exemplary feature amount extracted by the extractor 130 is shown in the following table.

TABLE 2

| Extraction data | | | | | | | | |
|---|---|---|---|---|---|---|---|---|
| Acceleration A (first axis) | | | Acceleration B (second axis) | | | Acceleration C (third axis) | | |
| Minimum value | Maximium value | Standard deviation | Minimum value | Maximum value | Standard deviation | Minimum value | Maximum value | Standard deviation |
| −30 | −10 | 2.0 | 90 | 110 | 2.5 | 52 | 31 | 2.3 |

The extractor 130 calculates a minimum value, a maximum value and a standard deviation of data in each field as feature amounts to generate extraction data as shown in Table 2 from the data shown in the fields of "acceleration A", "acceleration B" and "acceleration C" its Table 1 The extraction data is output to the determination processor 140.

The determination processor 140 includes an estimation portion 141 and a determination portion 142. The estimation portion 141 estimates it on the basis of the extraction data which of strength categories a floor belongs to, the washing machine 200 being placed on the floor. The determination portion 142 determines it on the basis of the estimation result whether a control pattern has to be changed. These elements are described below.

Upon receipt of the extraction data, the estimation portion 141 reads a correlation model (a model indicative of correlation between a strength of the floor on which the washing machine 200 is placed and the aforementioned feature amount) stored in advance in the model storage portion 150. The correlation model may be experimentally created. It is described below exemplarily how to create the correlation model.

Figure 3:
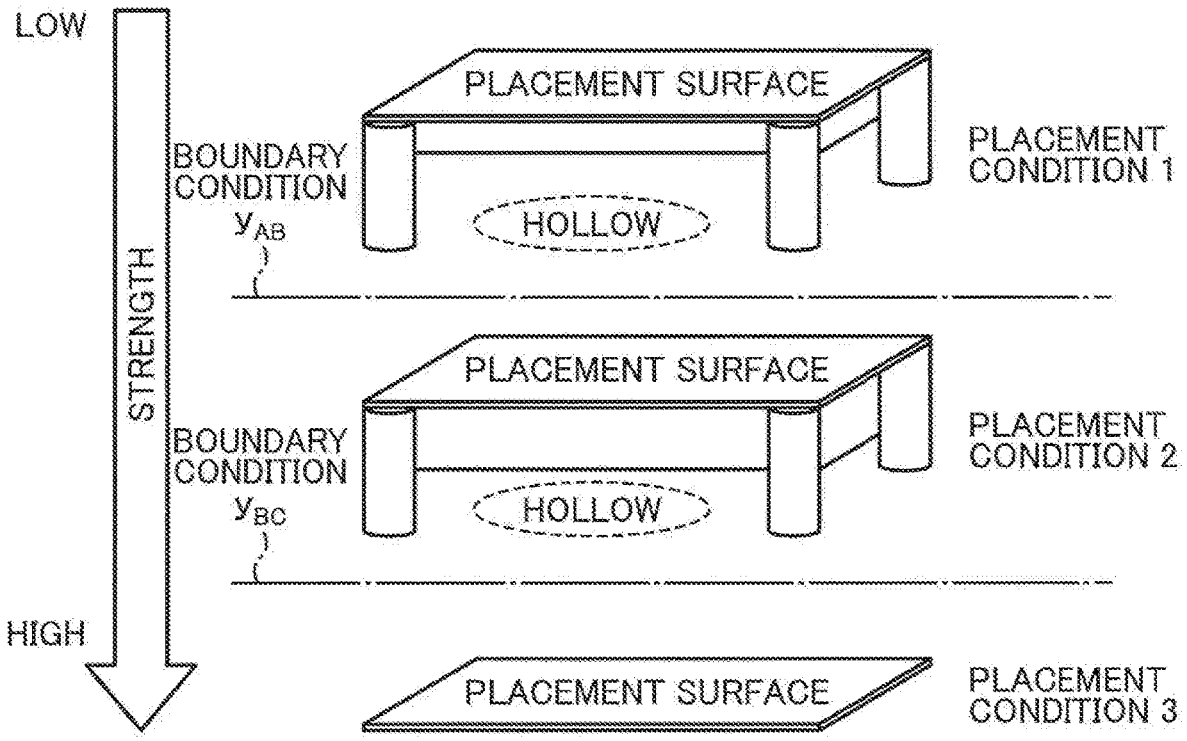
FIG. 3 is a conceptual view showing an exemplary experiment condition for creating a correlation model for use in determination process executed by the control device.

FIG. 3 is a conceptual view showing an exemplary experiment condition for creating a correlation model. An experiment condition for creating a correlation model is described with reference to FIGS. 1 to 3.

FIG. 3 shows three placement conditions (placement conditions 1 to 3) about a placement surface on, which the washing machine 200 is placed. The placement condition 1 is about a placement surface formed by a thin wooden plate supported in the air by poles. The placement condition 2 is about a placement surface formed by a thick wooden plate supported in the air by poles. The placement condition 3 is about a placement surface formed by a steel plate placed on the ground. With regard to strengths of the placement surfaces (i.e. the degree of less liability of deformation of the placement surface), the placement condition 1 has the lowest strength whereas the placement condition 3 has the highest strength. The strength of the placement surface is one of factors which affect vibration the most. Under a condition without laundry in the washing tub 241, the washing machine 200 is operated on each placement surface of the placement conditions 1 to 3, so that vibration information (log information shown in the fields of "acceleration A", "acceleration B" and "acceleration C" in "Table 1") is recorded, the vibration information being represented by the vibration detection signal output from the vibration detector 271.

The obtained vibration information is analyzed by a predetermined machine learning algorithm. The machine learning algorithm is designed so as to identify a boundary condition for sorting vibration information into data groups. For example, a machine learning algorithm may be a K-means algorithm or a logistic regression algorithm.

The boundary conditions generated by the machine learning algorithm are represented by symbols "$y_{AB}$" and "$y_{BC}$" in FIG. 3. The boundary condition represented by the symbol "$y_{AB}$" shows a boundary between a data group obtained under the placement condition 1 and a data group obtained under the placement condition 2. The boundary condition represented by the symbol "$y_{BC}$" shows a boundary between a data group obtained under the placement condition 2 and a data group obtained under the placement condition 3. The formulas representing the boundary conditions "$y_{AB}$" and "$y_{BC}$" are shown below.

$$y_{AB}=a_{AB0}x_0+a_{AB1}x_1+\ldots+a_{ABn}x_n+b_{AB}$$

$$y_{BC}=a_{BC0}x_0+a_{BC1}x_1+\ldots+a_{BCn}x_n+b_{BC} \quad \text{[Formula 1]}$$

$a_{AB0}$ to $a_{ABn}$: coefficient determined by the machine learning algorithm $a_{BC0}$ to $a_{BCn}$: coefficient determined by the machine learning algorithm $b_{AB}$, $b_{BC}$: intercept determined by machine learning algorithm $x_0$ to $x_n$: feature amount (e.g. minimum value, maximum value, and standard deviation of vibration accelerations)

The boundary conditions "$y_{AB}$" and "$y_{BC}$" represented by the aforementioned formulas are stored as correlation models in the model storage portion 150. The stored correlation models are used for the estimation process of the estimation portion 141 of the determination processor 140. The estimation process of the estimation portion 141 is described below.

The estimation portion 141 reads the correlation model stored in the model storage portion 150. The estimation, portion 141 applies a feature amount (c.f. "Table 2") to the correlation model (i.e. substitute a minimum value, a maximum value and a standard deviation in "Table 2" for $x_0$ to $x_n$) to calculate values of the boundary conditions "$y_{AB}$" and "$y_{BC}$", the feature amount having been output from the extractor 130. The estimation portion 141 estimates it based on the calculation values of the boundary conditions "$y_{AB}$" and "$y_{BC}$" under which of the placement conditions 1 to 3 the feature amount shown in "Table 2" is obtained. Exemplary estimation process of the estimation portion 141 is conceptually shown in the following table.

TABLE 3

| Calculation value of boundary condition | Estimation result |
|---|---|
| $y_{AB} > 0$ | Estimated to be vibration information obtained from placement condition 1 |
| $y_{AB} < 0$, $y_{BC} > 0$ | Estimated to be vibration information obtained from placement condition 2 |
| $y_{BC} < 0$ | Estimated to be vibration information obtained from placement condition 3 |

According to "Table 3", when the calculation value of the boundary condition "$y_{AB}$" is a positive value, an estimation result that the feature amount is the vibration information obtained from the placement condition 1 is output from the estimation portion 141 to the determination portion 142. When the calculation value of the boundary condition "$y_{AB}$" is a negative value whereas the calculation value of the boundary condition "$y_{BC}$" is a positive value, an estimation result that the feature amount is the vibration information obtained from the placement condition 2 is output from the estimation portion 141 to the determination portion 142. When the calculation value of the boundary condition "$y_{BC}$" is a negative value, an estimation result that the feature amount is the vibration information obtained from the placement condition 3 is output from the estimation portion 141 to the determination portion 142. The determination process of the determination portion 142 after the reception of the estimation result is described below.

The determination portion 142 determines it on the basis of the estimation result whether a control program which is currently executed is to be changed. The determination portion 142 stores three control programs (hereinafter, referred to as "control program 1", "control program 2" and "control program 3") which are associated with three estimation results (c.f. "Table 3") that the estimation portion 141 may possibly estimate. A correspondence table showing a relationship between the three estimation results and the three control programs is shown below.

TABLE 4

| Estimation result | Control program |
|---|---|
| Estimated to be vibration information obtained from placement condition 1 | Control program 1 |
| Estimated to be vibration information obtained from placement condition 2 | Control program 2 |
| Estimated to be vibration information obtained from placement condition 3 | Control program 3 |

The control program 1 is stored in the storage portion 274 of the washing machine 200 as a program designed to suppress vibrations to be a low level under the placement condition 1. The control program 2 is stored in the storage portion 274 of the washing machine 200 as a program designed to suppress vibrations to be a low level under the placement condition 2. The control program 3 is stored in the storage portion 274 of the washing machine 200 as a program designed to suppress vibrations to be a low level under the placement condition 3.

The determination portion 142 has information indicating which control program is currently executed in addition to the correspondence relationship between these control programs and the three estimation results. When the determination portion 142 did not request a change of a control program previously, "the control program 2" suitable for the placement condition 2 is handled as the control program which is currently executed. When the determination portion 142 previously requested a change of a control program, a control program set immediately before is handled as the control program which is currently executed.

When the estimation result that the feature amount is vibration information obtained from the placement condition 1 or 3 is output from the estimation portion 141 to the determination portion 142 under a condition that the control program which is currently executed is the control program 2, the determination portion 142 determines that the control program 2 should be changed to the control program 1 or 3. In this case, the determination portion 142 generates a control instruction requesting a change of the control program 2 to the control program 1 or 3. On the other hand, when the estimation result that the feature amount is vibration information obtained from the placement condition 2 is output from the estimation portion 141 to the determination portion 142, the determination portion 142 determines that no change of the control program is required. In this ease, a control instruction is generated to request maintaining the control program 2.

The control instruction requesting a change of a control program or maintaining a control program is output from the determination portion 142 to the communication portion 110. The control instruction is then sent to the washing machine 200 through communication between the communication portions 110, 281 of the control device 100 and the washing machine 200 and transmitted to the control pattern changer 282 of the washing machine 200.

The control pattern changer 282 operates according to the control instruction. When the control instruction instructs a change from the control program 2 to the control program 1, the control pattern changer 282 reads the control program 1 from the storage portion 274 and outputs the read control program 1 to the drive controller 283. In this case, the drive controller 283 controls the motor 242 according to the control program 1. Likewise, when the control instruction instructs a change from the control program 2 to the control program 3, the control pattern changer 282 reads the control program 3 from the storage portion 274 and outputs the read control program 3 to the drive controller 283. In this case, the drive controller 283 controls the motor 242 according to the control program 3. When the control instruction instructs maintaining the control program 2, the control pattern changer 282 does not execute output operation of the control program. In this case, the drive controller 283 controls the motor 242 according to the control program 2.

In addition to the drive controller 383, the control pattern changer 282 executes operation for the display controller 284 in response to the control instruction. When the control instruction instructs a change of the control program 2 to the control program 1 or 3, the control pattern changer 282 requests the display controller 284 to display a confirmation image for confirming acceptance or refusal of the change of the control program. When the control instruction instructs maintaining the control program 2, the control pattern changer 282 requests the display controller 284 to display a notification image indicating that no change of the control program is conducted or that it is recommended to maintain the control program. The display controller 284 controls the display portion 231 to display an, image according to a request from the control pattern changer 282.

Timing of the determination process of determining whether a control program is to be changed is determined by a user. For example, when the user feels large vibrations of the washing machine 200, the determination process may be executed. Operation of the washing machine 200 at the time of execution of the determination process is described below.

Figure 4:
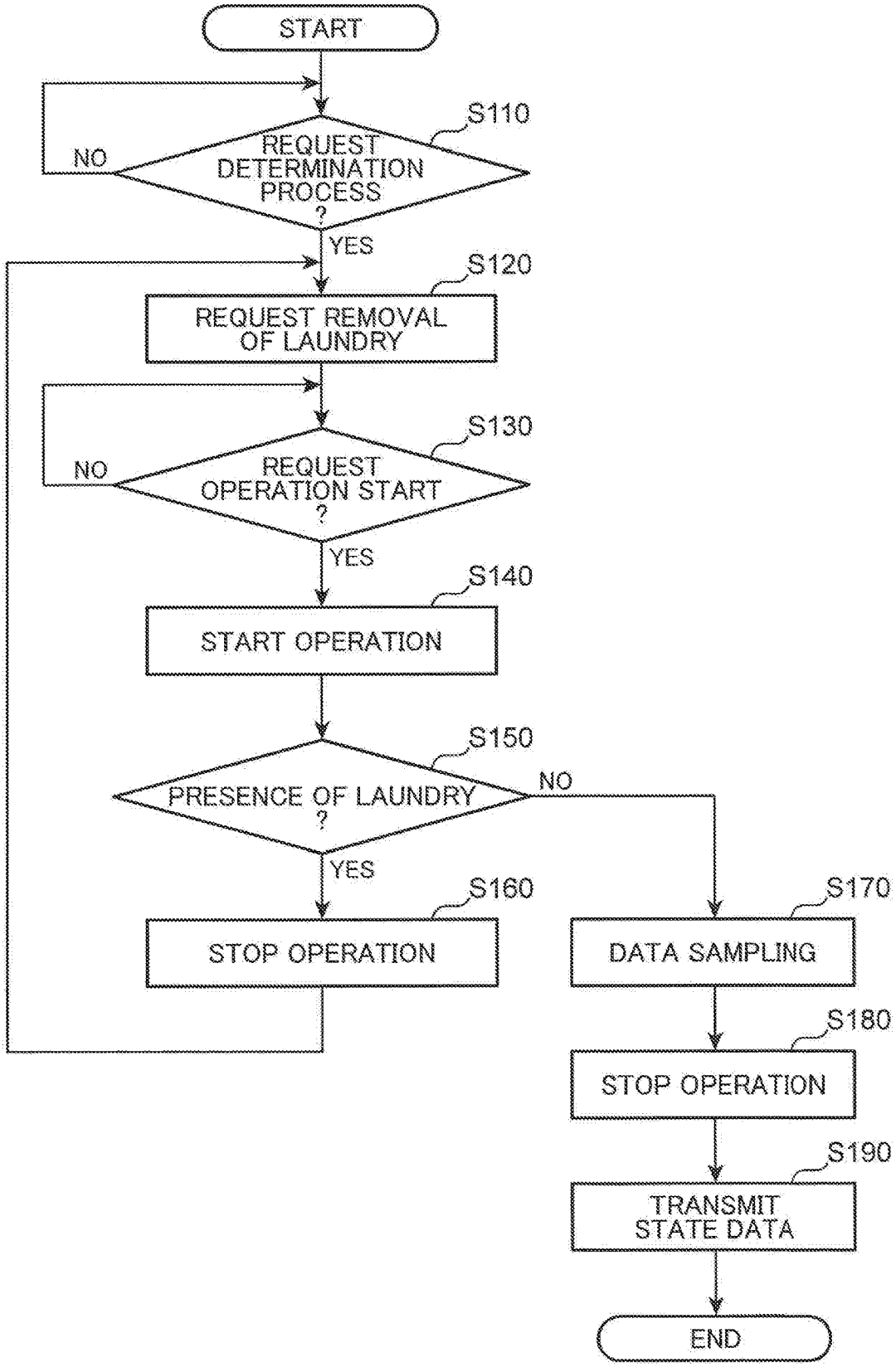
FIG. 4 is a schematic flow chart showing exemplary operation of the washing machine at the time of the determination process.

FIG. 4 is a schematic flow chart showing exemplary operation of the washing machine 200 at the time of execution of the determination process. Operation of the washing machine 200 at the time of execution, of the determination process is described with reference to FIGS. 1, 2 and 4.

(Step S110)

The washing machine 200 waits for a user to, request the determination process. When the user operates the input portion 232 to request the determination process, the request for the determination process is output from the input portion 232 to the control pattern changer 282. Step 8120 is then executed.

(Step S120)

The control pattern changer 282 requests the display controller 284 to display a message image for encouraging removal of =laundry from the washing tub 241. The display controller 284 causes the display portion 231 to display the requested message image in response to the request from the control pattern changer 282. After displaying the message image, Step S130 is executed.

(Step S130)

The washing machine 200 waits for the user to request operation start of the washing machine 200. When the user operates the input portion 232 to request the operation start of the washing machine 200, the request for the operation start is output from the input portion 232 to the control pattern changer 282. Step S140 is then executed.

(Step S140)

The control pattern changer 282 instructs the drive controller 283 to rotate the motor 242. The drive controller 283 rotates the motor 242 in response to the instruction from the control pattern changer 282. Meanwhile, the drive controller 283 controls the motor 242 using the control program 2 (the control program used before Step S110). After the start of control of the motor 242, Step S150 is executed.

(Step S150)

During rotation of the motor 242, the rotation detector 272 detects a torque current of the motor 242 to generate a rotation detection signal indicative of the torque current value. The rotation detection signal is output from the rotation detector 272 to the storage portion 274. The storage portion 274 stores the torque current value indicated by the rotation detection signal. The torque current value is read from the storage portion 274 by the measurement portion 273. The measurement portion 273 converts the read torque current value into an amount of laundry. The measurement portion 273 determines whether there is laundry in the washing tub 241 on the basis of the conversion value. When the measurement portion 273 determines that there is laundry in the washing tub 241, Step S160 is executed. Otherwise, Step S170 is executed.

(Step S160)

A notification indicating that there is laundry in the washing tub 241 is output from the measurement portion 273 to the control pattern changer 282. In response to the notification from the measurement, portion 273, the control pattern changer 282 instructs the drive controller 283 to stop the motor 242. In response to the instruction from the control pattern changer 282, the drive controller 283 stop the motor 242. Step S120 is then executed.

(Step S170)

The storage portion 274 stores vibration accelerations indicated by vibration detection signals output from the vibration detector 271 at predetermined time intervals to generate the state data (c.f. "Table 1"). When the vibration accelerations are stored for a predetermined period or when a predetermined amount of the vibration information is stored in the storage portion 274, Step S180 is executed.

(Step S180)

The control pattern changer 282 instructs the drive controller 283 to stop the motor 242. The drive controller 283 stops the motor 242 in response to the instruction from the control pattern changer 282. Step 8190 is then executed.

(Step S190)

The communication portion 281 reads the state data from the storage portion 274 to generate the transmission data as described with reference to Table 1. Since the determination request is made in Step S110, the data in the field of the determination request of the transmission data indicates "ON" at this time. The generated transmission data is transmitted from the communication portion 281 of the washing machine 200 to the communication portion 110 of the control device 100 through the communication network CNW.

The control device 100 uses the transmission data received by the communication portion 110 to determine whether a change of the control program is required. Operation of the control device 100 which determines whether a change of the control program is required is described below.

Figure 5:
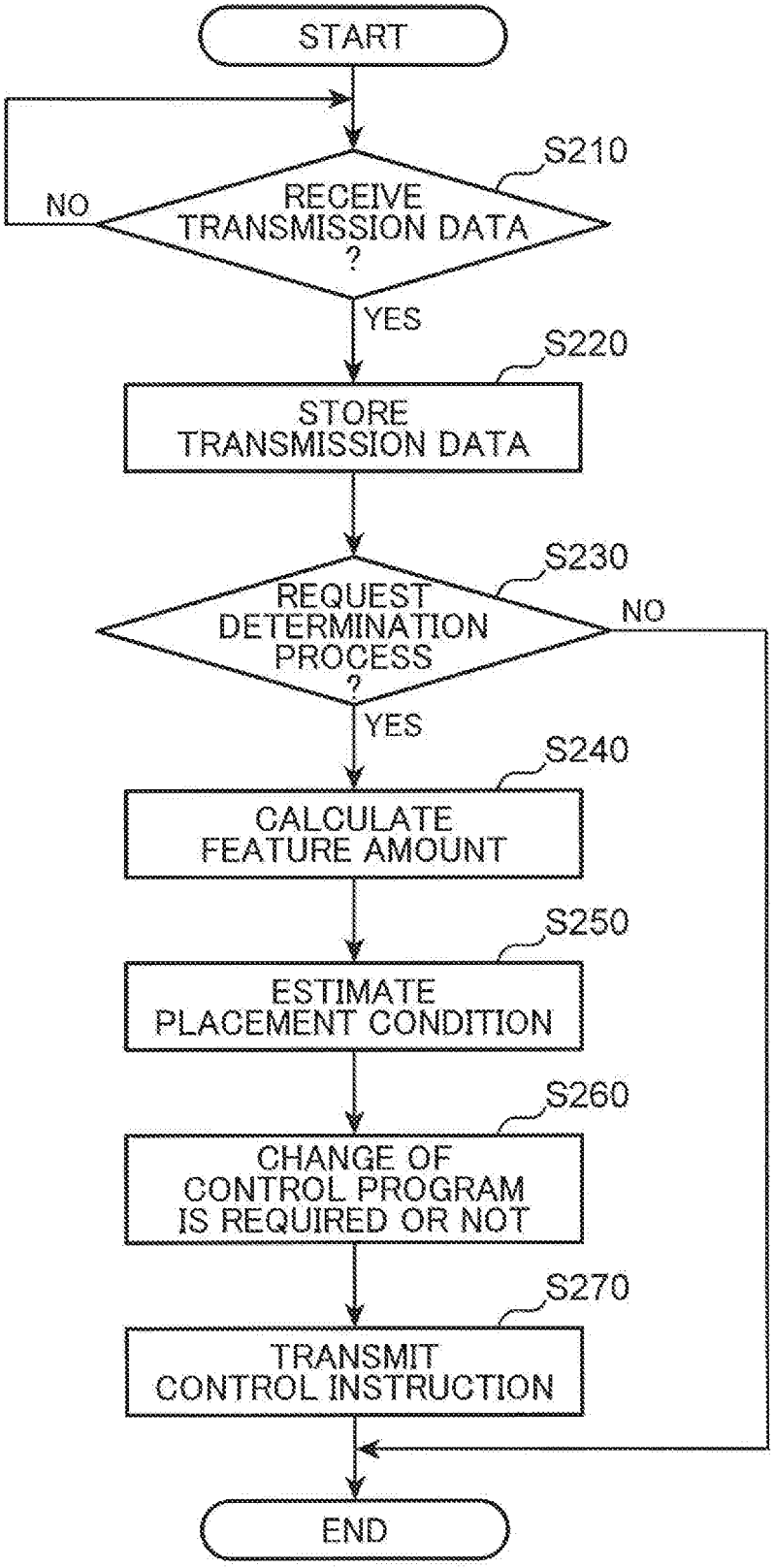
FIG. 5 is a schematic flow chart showing exemplary operation of the control device.

FIG. 5 is a schematic flow chart showing exemplary operation of the control device 100. The operation of the control device 100 is described with reference to FIGS. 1 and 5.

(Step S210)

The control device 100 waits for the transmission data (c.f. Table 1). When the communication portion 110 of the control device 100 receives the transmission data from the washing machine 200, Step S220 is executed.

(Step S220)

The transmission data is stored in the data storage portion 121. The storage of the transmission data is notified from the data storage portion 121 to the output processor 122. Step S230 is then executed.

(Step S230)

The output processor 122 confirms whether the field of "determination request" in the transmission data (c.f. Table 1) indicates "ON". When the field of "determination request" indicates "ON", Step S240 is executed. When the field of "determination request" indicates "OFF", the control device 100 ends the determination process.

(Step S240)

The output processor 122 outputs the transmission data to the extractor 130. The extractor 130 extracts a feature amount from the transmission data to generate the extraction data (c.f. "Table 2"). The extraction data is output front the extractor 130 to the estimation portion 141. Step S250 is then executed.

(Step S250)

The estimation portion 141 after reception of the extraction data reads the correlation model (c.f. "Formula 1") from the model storage portion 150. The estimation portion 141 applies the extraction data to the read correlation model to calculate the boundary conditions "$y_{AB}$" and "$y_{BC}$". The estimation portion 141 estimates it on the basis of the calculation values of the boundary conditions "$y_{AB}$" and "$y_{BC}$" (c.f. "Table 3") from which of the placement conditions 1 to 3 the extraction data is obtained. The estimation result is output from the estimation portion 141 to the determination portion 142. Step S260 is then executed.

(Step S260)

The determination portion 142 determines whether a control program (c.f. "Table 4") in correspondence to the placement condition indicated by the estimation result is coincident with the current control program (the control program 2 with regard to the present embodiment). When these control programs are coincident with each other, the determination portion 142 determines that a change of the control program is not required. In this case, the determination portion 142 generates a control instruction to instruct maintaining the control program. When these control programs are not coincident with each other, the determination portion 142 determines that a change of the control program is required. In this case, the determination portion 142 generates a control instruction to instruct a change of the control program. The generated control instruction is output from the determination portion 142 to the communication portion 110. Step S270 is then executed.

(Step S270)

The communication portion 110 of the control device 100 transmits the control instruction to the communication portion 281 of the washing machine 200.

When the communication portion 281 of the washing machine 200 receives the control instruction, the washing machine 200 operates according to the control instruction. The operation of the washing machine 200 according to the control instruction is described below.

Figure 6:
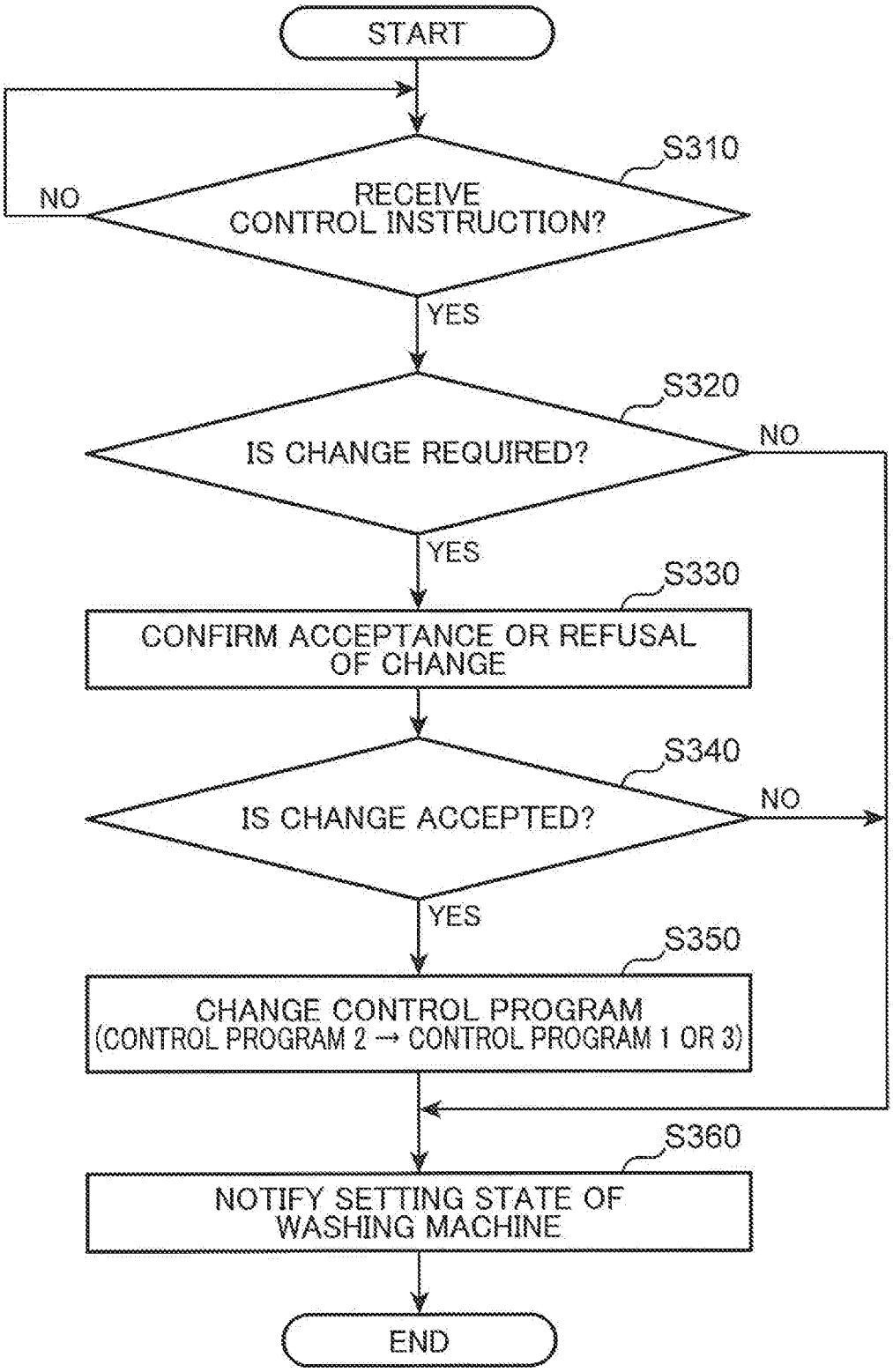
FIG. 6 is a schematic flow chart showing exemplary operation of the washing machine in response to a control instruction from the control device.
Figure 7A:
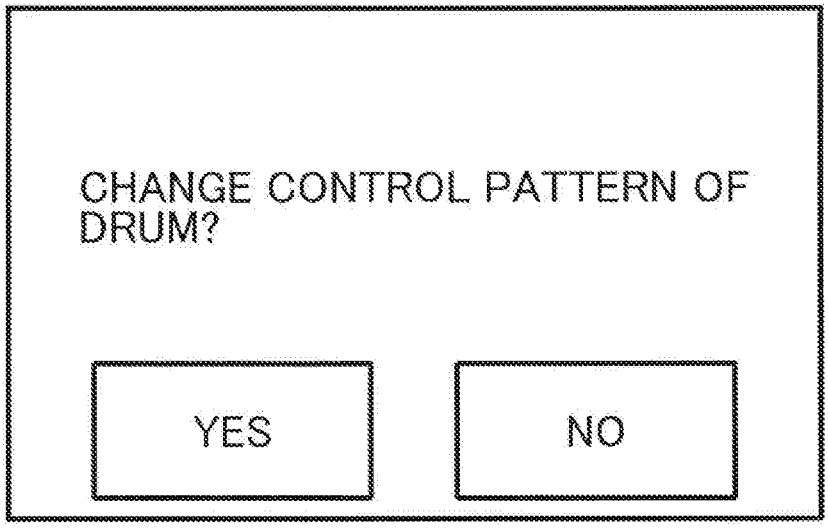
FIG. 7A shows an exemplary image displayed in a display portion of the washing machine.
Figure 7B:
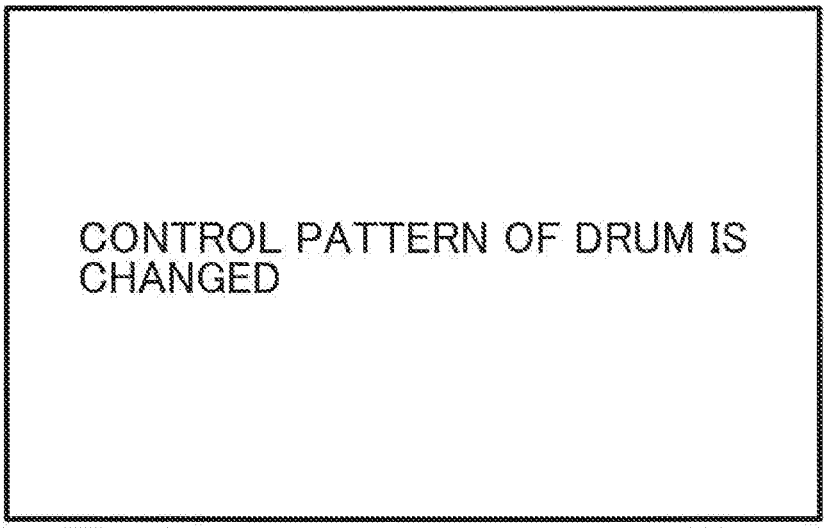
FIG. 7B shows an exemplary image displayed in the display portion of the washing machine.
Figure 7C:
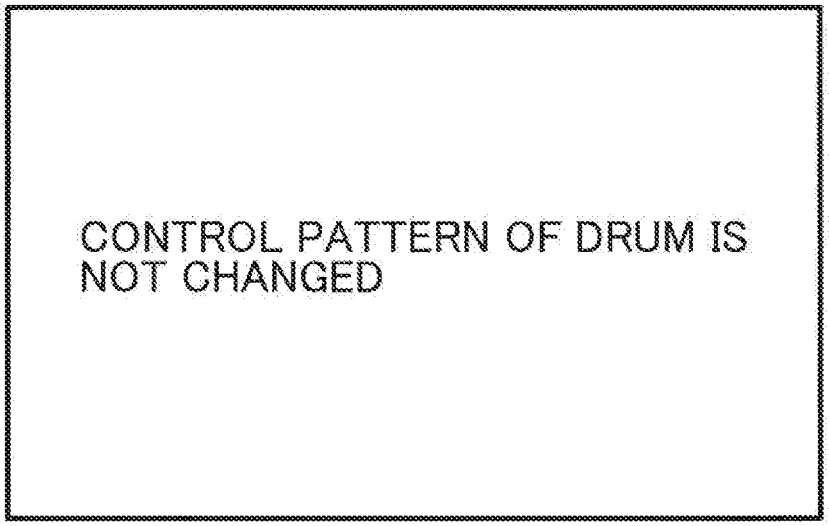
FIG. 7C shows an exemplary image displayed in the display portion of the washing machine.

FIG. 6 is a schematic flow chart showing exemplary operation of the washing machine 200 in response to a control instruction. FIGS. 7A to 7C show exemplary images displayed in the display portion 231 of the washing machine 200. The operation of the washing machine 200 in response to the control instruction is described below with reference to FIGS. 1, 5 to 7C.

(Step S310)

The washing machine 200 waits for a control instruction. When the communication portion 281 of the washing machine 200 receives the control instruction, the control instruction is transmitted from the communication portion 281 to the control pattern changer 282. Step S320 is then executed.

(Step S320)

The control pattern changer 282 determines it on the basis of the contents of the control instruction whether a change of the control program is required. When the control instruction instructs a change of the control program, Step S330 is executed. Otherwise, Step S360 is executed.

(Step S330)

The control pattern changer 282 requests the display controller 284 to display a confirmation image for confirming whether a user accepts a change of the control program. The display controller 284 causes the display portion 231 to display a confirmation image (c.f. FIG. 7A) in response to a request from the control pattern changer 282. Step S340 is then executed.

(Step S340)

The user watching the confirmation image displayed in the display portion 231 operates the input portion 232 (press a "Yes" or "No" button image in FIG. 7A) to determine whether or not to accept a change of the control program. The user's determination is output from the input portion 232 to the control pattern changer 282. When the user accepts a change of the control program, Step S350 is executed. Otherwise, Step S360 is executed.

(Step S350)

The control pattern changer 282 reads the control program (the control program 1 or 3 with regard to the present embodiment) instructed by the control instruction from the storage portion 274. The read control program is output from the control pattern changer 282 to the drive controller 283. The drive controller 283 then controls the motor 242 according to a new control program. After the output of the control program from the control pattern changer 282 to the drive controller 283, Step S360 is executed.

(Step S360)

The control pattern changer 282 requests the display controller 284 to display a notification image for notifying a setting state of the washing machine 200. The display controller 284 causes the display portion 231 to display a notification image in response to the request from the control pattern changer 282. When Step S350 is not executed, the notification image indicates that the operation mode of the washing machine 200 has not been changed (c.f. FIG. 7C). When Step S350 is executed, the notification image indicates that the operation mode of the washing machine 200 has been changed (c.f. FIG. 7B).

As a result of the execution of Step S350, the control program to be executed by the washing machine 200 is changed. The control device 100 is notified through communication between the communication portions 281, 110 of the washing machine 200 and the control device 100 that the control program has been changed or unchanged. When the notification from the washing machine 200 to the control device 100 indicates that the control program has been changed, the determination portion 142 stores the control program (the control program 1 or 3 with regard to the present embodiment) designated by the control instruction generated in Step S270 as the current control program. When the notification from the washing machine 200 to the control device 100 indicates that the control program has not been changed, as a current control program, the determination portion 142 stores the control program (the control program 2 with regard to the present embodiment), which was used as a current control program before generation of control instruction.

After the control program is change a placement condition of the washing machine 200 may be changed (e.g. in a case of house movement). In this case, the user may operate the input portion 232 to reset setting of the control program (i.e, may return the control program to be used to the control program 2). Upon the resetting operation by the user, the reset request for a control program is output from the input portion 232 to the control pattern changer 282. The control pattern changer 282 reads the control program 2 from the storage portion 274 in response to the reset request. The read control program 2 is output from the control pattern changer 282 to the drive controller 283. The drive controller 283 then controls the motor 242 on the basis of the control program 2. Along, with the output of the control program 2 to the drive controller 283, the control pattern changer 282 transmits the reset request to the washing machine 200 through communication between the communication portions 281, 110 of the washing machine 200 and the control device 100. The determination portion 142 of the washing machine 200 stores the control program 2 as a current control program in response to the reset request.

An image displayed in the display portion 231 may be changed between a case where the control program 2 is used as the current control program and a case where the control program 1 or 3 is used as the current control program. In this case, the user may watch the display portion 231 to understand that the operation mode of the washing machine 200 is a default operation mode or an operation mode changed from the default operation mode. Accordingly, the user may confirm whether the operation mode of the washing machine 200 has been changed in the past.

The control programs 1 to 3 used for changing the operation mode of the washing machine 200 are designed to reduce vibrations of the washing machine 200 under the placement conditions 1 to 3 in correspondence to these programs. The control program is, described below.

<Control Program>

Each of the control programs 1 to 3 may be designed on the basis of a result of the vibration experiment described with reference to FIG. 3. Vibration characteristics obtained from the vibration experiment are described below.

Figure 8:
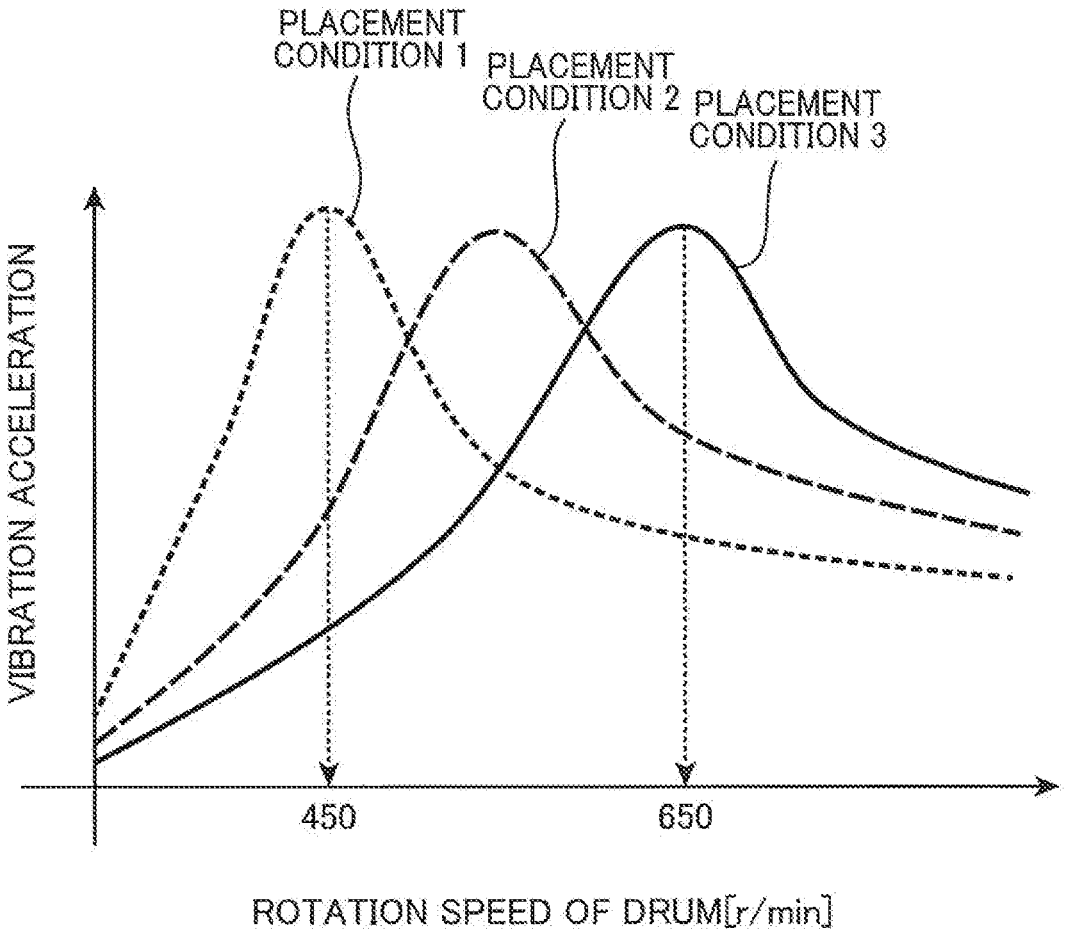
FIG. 8 is a graph showing a schematic relationship between a vibration acceleration detected by a vibration detector of the washing; machine and a rotation speed of a drum of the washing machine.

FIG. 8 is a graph showing a schematic relationship between a vibration acceleration detected by the vibration detector 271 and a rotation speed of the drum 246. The relationship between a vibration acceleration and a rotation speed of the drum 246 is described below with reference to FIGS. 2 and 8.

FIG. 8 shows that the vibration acceleration reaches a peak at the rotation speed of 450 rpm under the placement condition 1. The vibration acceleration reaches a peak at the rotation speed of 500 rpm under the placement condition 2. The rotation speed reaches a peak at the rotation speed of 650 rpm under the placement, condition 3. It may be found from the data shown in FIG. 8 that the rotation speed at which the vibration acceleration reaches a peak is increased as a strength of the floor, is increased.

The control programs 1 to 3 are designed on the basis of the vibration characteristics shown in FIG. 8. The control program is designed so that a rotation period at a rotation speed near 450 rpm of the drum 246 becomes short. The control program 2 is designed so that a rotation period at a rotation speed near 500 rpm of the drum 246 becomes short. The control program 3 is designed so that a rotation period at a rotation speed near 650 rpm of the drum 246 becomes short. The operation mode of the washing machine 200 (i.e. The change pattern of the rotation speed of the drum 246) set by the control programs 1 to 3 is described below.

Figure 9:
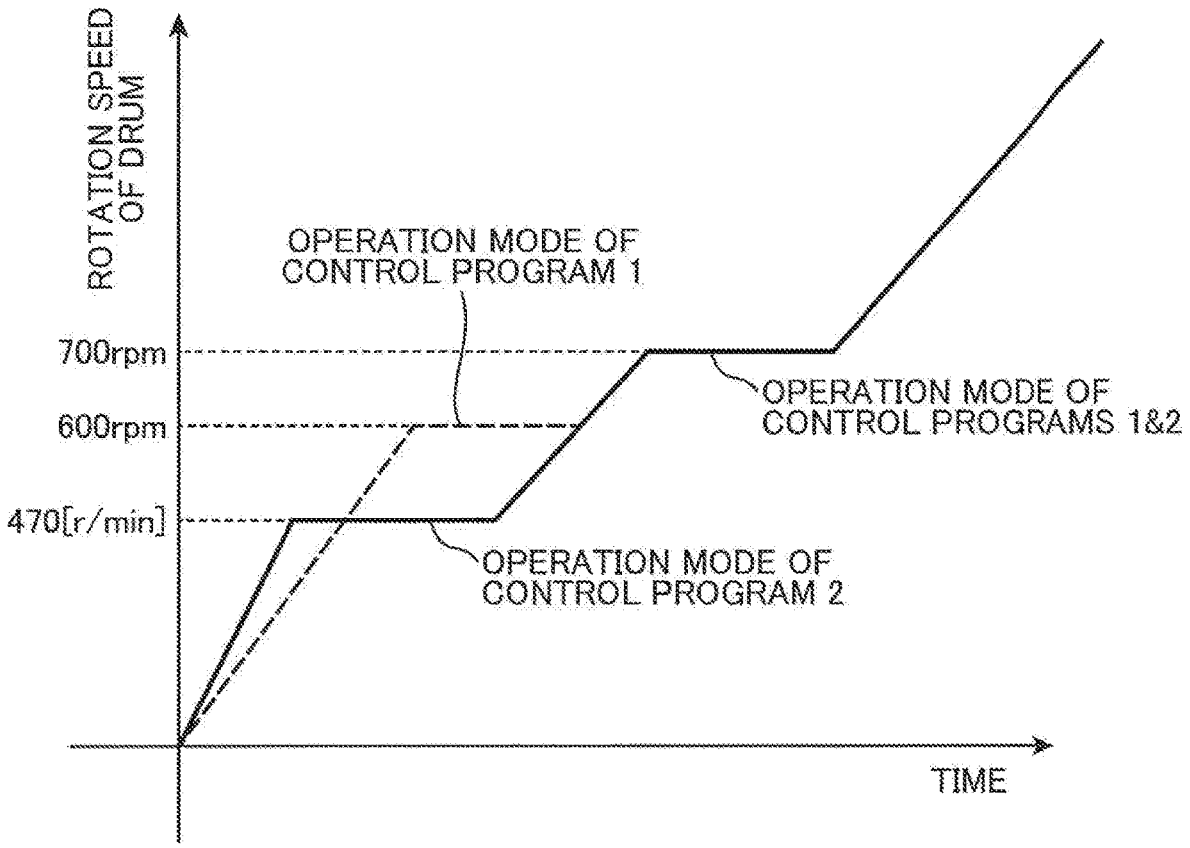
FIG. 9 is a schematic graph showing operation modes of the washing machine set by a control program 1 and a control program 2.

FIG. 9 is a schematic graph showing operation modes of the washing machine 200 set by the control programs 1 and 2. The operation modes in FIG. 9 show a change pattern of the rotation speed of the drum 246 in the spin-drying step. The operation mode of the washing machine 200 is described with reference to FIGS. 1, 2, 5, 8 and 9.

FIG. 9 shows that a steady period is set under the execution of the control program 1, the rotation speed of the drum 246 being maintained to be generally fixed to 600 rpm in the steady period. Steady periods are set under the execution of the control program 2 so that the rotation speed of the drum 246 is maintained to be generally fixed to 470 rpm and 700 rpm in the steady periods. These steady periods are provided to sufficiently spin-dry laundry in the washing tub 241. The period in which the rotation speed of 600 rpm is maintained is shorter than the period in which the rotation speed of 470 rpm is maintained. However, since the rotation speed of 600 rpm is higher than the rotation speed of 470 rpm, the laundry is sufficiently spin-dried even in the short period.

The rotation speed of 470 rpm is close to the rotation speed of 450 rpm at which the vibration acceleration reaches a peak under the placement condition 1 (c.f. FIG. 8). Accordingly, when large vibrations happen in the steady period in which the rotation speed of 470 rpm is maintained, the estimation portion 141 determines that the washing machine 200 is placed under a placement condition close to the placement condition 1 in Step S250 described with reference to FIG. 5, in this case, in Step S260 described with reference to FIG. 5, the determination portion 142 generates a control instruction which instructs a change of the control program 2 to the control program 1. Since the control program 1 is designed so that a rotation period at a rotation speed near 450 rpm of the drum 246 becomes short as described above, a period when the number of rotations of the drum 246 is close to 470 rpm becomes short. In short, the rotation speed of the drum 246 instantaneously exceeds the rotation speed of 470 rpm to reach 600 rpm under the execution of the control program 1. Accordingly, as a result of a change of the control program 2 to the control program 1, there are effectively reduced vibrations of the washing machine 200.

The change of the control program 2 to the control program 1 is effective to reduce large vibrations happening in the steady period of a low rotation speed (470 rpm). On the other hand, large vibrations happening in the steady period of a high rotation speed (700 rpm) are reduced by a change of the control program 2 to the control program 3. Techniques for reducing large vibrations happening in the steady period of a high rotation speed (700 rpm) are described below.

Figure 10:
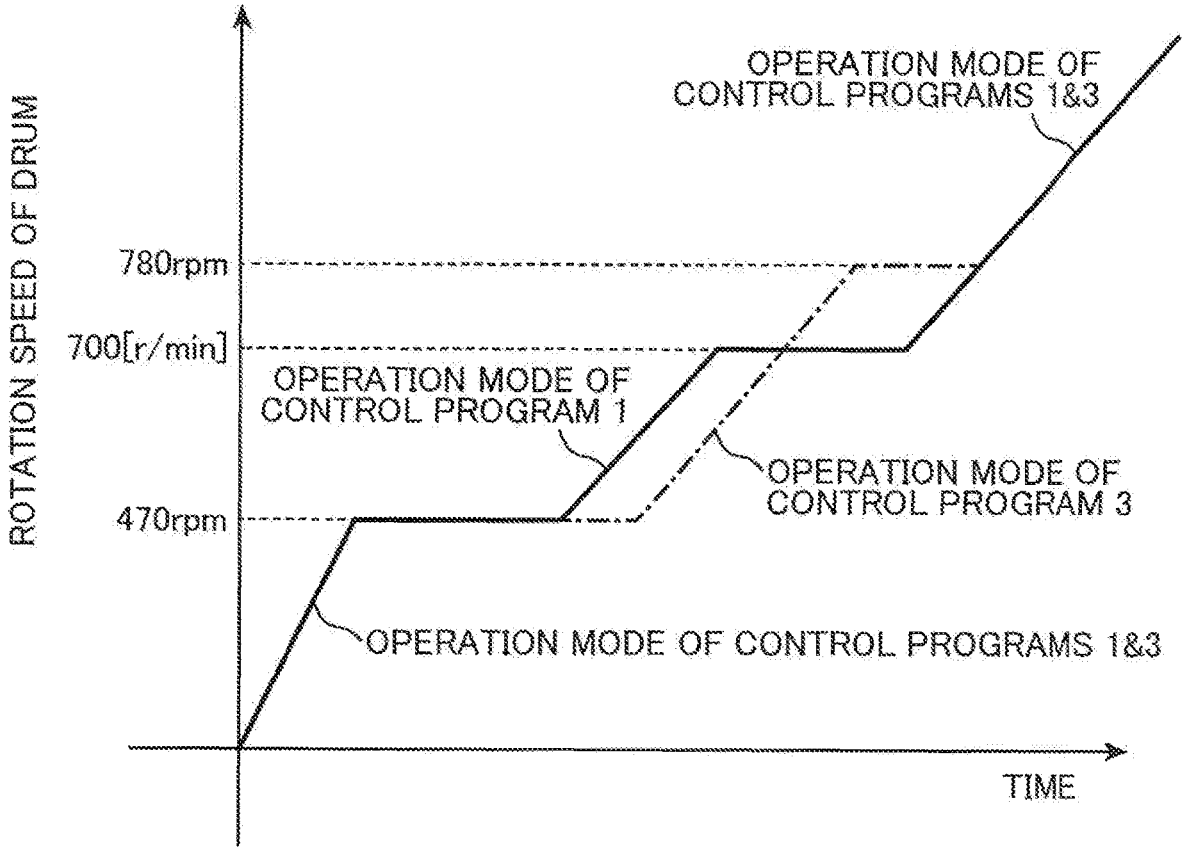
FIG. 10 is a schematic graph showing operation modes of the washing machine set by the control program 2 and the control program 3.

FIG. 10 is a schematic graph showing the operation modes of the washing machine 200 set by the control programs 2 and 3. The operation modes of the washing machine 200 are described with reference to FIGS. 1, 2, 5, 8 and 10.

FIG. 10 shows that the steady period in which the rotation speed is maintained to be generally fixed to 470 rpm becomes longer under the execution of the control program 3 than under the control program 1. Additionally, the control program 3 sets a steady period in which the rotation speed of the drum 246 is maintained at 780 rpm. The rotation speed of 780 rpm set during the steady period by the control program 3 is significantly higher than the rotation speed of 700 rpm set during the steady period by the control program 1.

The rotation speed of 700 rpm is close to the rotation speed of 650 rpm at which the vibration, acceleration reaches a peak under the placement condition 3 (c.f. FIG. 8). Accordingly, when large vibrations happen in the steady period in which the rotation speed of 700 rpm is maintained, the estimation portion 141 determines that the washing machine 200 is placed under a placement condition close to the placement condition 3 in Step S250 as described with reference to FIG. 5. In this case, the determination portion 142 generates a control instruction to instruct a change of the control program 2 to the control program 3 in Step S260 described with reference to FIG. 5. Since the control program 3 is designed so that a period in which the drum 246 rotates at a rotation speed near 700 rpm becomes short as described above, a period in which the number of rotations of the drum 246 is near 700 rpm becomes short. In short, the rotation speed of the drum 246 instantaneously exceeds the rotation speed of 700 rpm to reach 780 rpm under the execution of the control program 3. Accordingly, as a result of the change of the control program 2 to the control program 3, there are reduced vibrations of the washing machine 200.

<Extraction of Vibration Information>

In order to determine whether a change of the control program is required, the extractor 130 extracts a feature amount from the vibration information. At this time, the extractor 130 may use a part of the vibration information to calculate a feature amount.

Since an average value and a standard deviation of vibration accelerations detected by the vibration detector 271 become small when the drum 246 rotates at a fixed rotation speed, vibration information obtained in the steady period is inappropriate for determining a placement condition. Accordingly, the extractor 130 may calculate a feature amount from the vibration information obtained in a time period excluding the steady period. The extractor 130 may refer to data in the field of "time" of the transmission data (c.f. Table 1) to discriminate a time period for use in calculation of a feature amount. Likewise, a correlation model (c.f. "Formula 1") for use in determination of a placement condition may be also created on the basis of the vibration information obtained in the time period excluding the steady period.

Accuracy of estimation of a placement condition using the correlation model was verified. A verification result of estimation accuracy is described below.

<Estimation Accuracy>

Feature amounts of vibrations obtained for verification of estimation accuracy are shown in the following table.

TABLE 5

| | Extraction data | | | | | | | | |
|---|---|---|---|---|---|---|---|---|---|
| | Acceleration A (first axis) | | | Acceleration B (first axis) | | | Acceleration C (first axis) | | |
| placeme condition | Minimum value | Maximum value | Standard deviation | Minimum value | Maximum value | Standard deviation | Minimum value | Maximum value | Standard deviation |
| placement condition 1 | −30 | −10 | 2.0 | 90 | 110 | 2.5 | 52 | 31 | 2.3 |
| placement condition 1 | −32 | −9 | 1.7 | 88 | 105 | 2.8 | 49 | 33 | 2.1 |
| . | . | . | . | . | . | . | . | . | . |
| . | . | . | . | . | . | . | . | . | . |
| . | . | . | . | . | . | . | . | . | . |
| placement condition 2 | −20 | 0 | 4 | 79 | 101 | 5 | 41 | 23 | 4.5 |
| placement condition 2 | −19 | 1 | 3.8 | 81 | 99 | 4.7 | 43 | 21 | 4.2 |
| . | . | . | . | . | . | . | . | . | . |
| . | . | . | . | . | . | . | . | . | . |
| . | . | . | . | . | . | . | . | . | . |
| placement condition 3 | −15 | −5 | 2 | 65 | 93 | 3.4 | 29 | 14 | 3.3 |
| placement condition 3 | −11 | −3 | 2.1 | 61 | 89 | 3.3 | 30 | 13 | 3.0 |
| . | . | . | . | . | . | . | . | . | . |
| . | . | . | . | . | . | . | . | . | . |
| . | . | . | . | . | . | . | . | . | . |

The present inventors conducted the experiment ten times under the placement condition 1 to obtain data of ten sets of feature amounts for the placement condition 1 in "Table 5". Likewise, the present inventors conducted the experiment ten times also under each of the placement conditions 2 and 3 to obtain data of ten sets of feature amounts for each of the placement conditions 2 and 3 in "Table 5". The present inventors caused the estimation portion 141 to estimate under which of the placement conditions the feature amount in "Table 5" was obtained. The estimation result is described below.

FIG. 11 shows an estimation result. The estimation result is described with reference to FIGS. 1 and 11.

The number of coincidences between an actual placement condition and an estimated placement condition is shown in a rectangular hatched region in FIG. 11. The estimation portion 141 made correct estimation for all the data obtained under the placement conditions 1 and 2. Also with respect to the data obtained under the placement condition 3, the estimation portion made correct estimation eight times. A percentage of correct estimation of the estimation portion 141 is 93% (=28/30×100%) as a whole. Accordingly, appropriate determination is made for a change of the control program on the basis of the estimation technique described in the context of the aforementioned embodiment.

According to the aforementioned embodiment, vibration information used for determining whether the control program should be changed is obtained from the vibration detector 271. The vibration sensor attached to the outer tub 245 of the washing tub 241 is used as the vibration detector 271. With regard to a general washing machine, vibration information output by a vibration sensor attached to a washing tub is used for determining whether laundry is unevenly present in the washing tub. With regard to the washing machine 200 according to the aforementioned embodiment, the vibration information output by the vibration sensor is used not only for the determination of the uneven presence of the laundry but also for the aforementioned determination process for reducing vibrations of the washing machine 200. Accordingly, the aforementioned techniques may use a vibration sensor mounted on a general washing, machine to contribute to a reduction in vibrations. In short, no additional sensor is required for reducing vibrations. Since vibrations resultant from rotation of the washing machine 200 and a placed position of the washing machine 200 are reduced without requiring an additional sensor, manufacturing costs of the washing machine 200 itself and power consumption of the washing machine 200 may be maintained at a low level.

With regard to the aforementioned determination process for reducing vibrations, a minimum value, a maximum value and a standard deviation of vibration accelerations are used as the feature amounts having correlation with a strength of a floor. For calculation of these feature amounts, vibration data of a part of a time period (a time period excluding a steady period) of vibration information is used. Accordingly, there is a reduced load on calculation for the determination process.

As a result of the determination process, one of the control programs 1 to 3 is selected as a control program used by the drive controller 283. The control program 1 is designed to obtain a low vibration level under the placement condition 1. The control program 2 is designed to obtain a low vibration level under the placement condition 2. The control program 3 is designed to obtain a low vibration level under the placement condition 3. Since it may be estimated accurately by the estimation portion 141 under which of the placement conditions 1 to 3 the washing machine 200 is placed, an appropriate control program is selected for a placement condition under which the washing machine 200 is placed. Accordingly, vibrations of the washing machine 200 may be suppressed to a low level.

The correlation model for use in estimating a placement condition is created by a machine learning algorithm. The machine learning algorithm is useful for sorting numerous data points into a few data groups. With regard to the aforementioned embodiment, the machine learning algorithm is used to obtain boundary conditions for dividing three data groups obtained under the placement conditions 1 to 3, respectively. It is estimated on the basis of the boundary conditions obtained from the machine learning algorithm to which of the placement conditions 1 to 3 a placement condition of the washing machine 200 is close. Accordingly, a placement condition under which the washing machine 200 is placed may be estimated with high accuracy of 93%.

Since a placement condition may be estimated with high accuracy by using a correlation model created by the machine learning algorithm, it is not necessary to check a resonance frequency of a floor on which the washing machine 200 is placed or of the surroundings thereof. Accordingly, the aforementioned control techniques are suitably used in various placed environments of the washing machine 200.

After the aforementioned estimation process, the determination process is conducted for determining whether a control program should be changed. Since the estimation process before the determination process is conducted accurately, an appropriate determination result may not be obtained from the determination process.

A determination result is displayed in the display portion 231 of the washing machine 200 (c.f. FIGS. 7A to 7C). Accordingly, a user may understand whether or not to change the operation, mode of the washing machine 200. Since a change of the operation mode of the washing machine 200 is conducted with user's acceptance, the operation mode of the washing machine 200 may be changed without user's realizing.

A placement condition of the washing machine 200 may be changed after a change it the operation mode of the washing machine 200. In this case, the user may operate the input portion 232 to return a control program used by the drive controller 283 to the control program If vibrations from the washing machine 200 are suppressed to a low level under the control program 2, the user may use the washing machine 200 under a new placement condition without subsequently changing an operation mode of the washing machine 200. On the other hand, if the washing machine 200 causes large vibrations under the new placement condition, the user may conduct the operation described with reference to FIGS. 4 and 6 to set an operation mode determined by a control program appropriate for the new placement condition.

The control described in the context of the aforementioned embodiment is applicable to washing machines with various structures. Accordingly, it should not be construed that the aforementioned control is applicable only to a specific washing machine.

The time data included in the state data described in the context the aforementioned embodiment is set with the operation start time of the washing machine as a reference. However, the time data may be a character string representing time and date when vibration information and a torque current value are obtained.

The vibration information included in the state data described in the context of the aforementioned embodiment represents vibration accelerations in three directions orthogonal to one another. However, the vibration information may represent vibration accelerations in two directions or more than three directions different from one another.

Alternatively, the vibration information may represent vibration accelerations in one direction.

The extraction data described in the context of the aforementioned embodiment includes a minimum value, a maximum value and a standard deviation of vibration accelerations. These are exemplary feature amounts having correlation with a strength of a floor on which the washing machine 200 is placed. However, the determination process for reducing vibrations may not use all of these feature amounts. Additionally, the determination process for reducing vibrations may use other feature amounts (e.g. an average value of a vibration acceleration) having correlation with a strength of a floor.

With regard to the aforementioned embodiment, a first operation mode of the washing machine 200 set by the control program 2 is changed to a second operation mode of the washing machine 200 set by the control program 1 or 3 in accordance with a determination result of the determination portion 142. However, the operation mode of the washing machine 200 set by the control program 1 may be changed to an operation mode set by the control program 2 or 3 in accordance to a determination result of the determination portion 142. Alternatively, an operation mode of the washing machine 200 set by the control program 3 may be changed to an operation mode set by the control program 1 or 2 in accordance with a determination result of the determination portion 142.

With regard to the aforementioned embodiment, the control device 100 instructs the washing machine 200 to change a control program to be used. However, the control device 1 may instruct a change of a target value in an acceleration mode in which the drum 246 accelerates toward a predetermined target number of rotations. With regard to the change from the control program 2 to the control program 1 described with reference to FIG. 9, the control program 2 sets a first target value of 470 rpm as a target value in the acceleration mode whereas the control program 1 sets a second target value of 600 rpm as a target value in the acceleration mode. A change of the target value from 470 rpm to 600 rpm may be instructed by the control device 100 to the washing machine 200. In addition to the change of a target value, an acceleration of the drum 246 may be instructed by the control device 100. In this case, a change pattern of a rotation speed of the drum 246 under the control program 2 shown in FIG. 9 is obtained. As described above, there are various instruction contents for changing an operation mode. Accordingly, the contents of the aforementioned control instruction are not to be construed limitative.

With regard to the aforementioned embodiment, when the control program 2 designed to suppress vibrations to be a low level under the placement condition 2 is changed to the control program 3 designed to suppress vibrations to be a low level under the placement condition 3, a period in which the rotation speed of the drum 246 is maintained at 470 rpm is extended (c.f. FIG. 10). However, if the vibration may be suppressed to be a low level under the placement condition 3, the period in which the rotation speed of the drum 246 is maintained at 470 rpm may be reduced. The control program is designed so that the following conditions are satisfied: (i) vibrations under a target placement condition are suppressed to be a low level; and (ii) an object of processing laundry (e.g. spin-drying) is attained. Accordingly, the change pattern of the rotation speed of the drum 246 described with reference to FIGS. 9 and 10 is not to be construed limitative.

With regard the aforementioned embodiment, three control programs (the control programs 1 to 3) are prepared for the washing machine 200. However, two control programs or more than three control programs may be prepared for the washing machine 200. It is determined on the basis of a correlation model stored in advance in the model storage portion 150 how many control programs are prepared for the washing machine 200. When the correlation model is configured to discriminate four placement conditions, four control programs are prepared for the washing machine 200.

With regard to the aforementioned embodiment, three placement surfaces are prepared in the experiment for creating a correlation model (c.f. FIG. 3). However, placement surfaces having different strengths for each of the placement conditions 1 to 3 may be prepared. It improves estimation accuracy for a placement condition to set each placement condition using the placement surfaces.

With regard to the aforementioned embodiment, the vibration reduction control in the spin-drying step is described (c.f. FIGS. 9 and 10). However, the aforementioned control techniques are applicable also to the washing step, the rinsing step and the drying step.

With regard to the aforementioned embodiment, the vibration data includes vibration accelerations obtained in the washing step, the rinsing step, the spin-drying step and the drying step. However, the vibration data may include vibration accelerations obtained in a part of these steps. In this case, start timing and end timing of sampling in the storage portion 274 may be set so as to obtain vibration data in a step which has a high risk of large vibrations (e.g. the spin-drying step).

With regard to the aforementioned embodiment, the communication portion 281 transmits transmission, data (c.f. Table 1) whenever execution of a control program ends. However, communication between the communication portions 281, 110 may be executed at various timings. Accordingly, the timings of communication between the communication portions 281, 110 are not to be construed limitative.

With regard to the aforementioned embodiment, after a user removes laundry from the washing tub 241, the determination process is conducted to determine whether a control program has to be changed (c.f. FIG. 4). However a threshold load (i.e. threshold value for use in determination in Step S150 in FIG. 4) may be determined so that the determination process is conducted even when a little laundry remains in the washing tub 241. Alternatively, Step S150 in FIG. 4 may not be executed. In this case, an operation term of a feature amount of the transmission data (c.f. "Table 1") (or an amount of laundry calculated from a torque current value) is included in the correlation model (c.f. "Formula 1") so that it is determined in consideration of a torque current value whether a control program has to be changed.

As the control device 100 described in the context of the aforementioned embodiment, a general computer is usable. The operation of the control device 100 described with reference to FIG. 5 is executed according to a computer program installed in the computer used as the control device 100.

With regard to the aforementioned embodiment, the control device 100 controls the washing machine 200. However, the control device 100 may control other washing machines. In short, the control device 100 may be a control server which controls the washing machines 200.

The aforementioned embodiment mainly includes control techniques having the following configurations.

The control method according to one aspect of the aforementioned embodiment is used for controlling an operation mode of a washing machine under communication with the washing machine. The control method includes obtaining vibration information indicative of vibrations of a washing tub of the washing machine operating under a predetermined first operation mode as the operation mode; extracting a predetermined feature amount from the vibration information, the feature amount having correlation with a strength of a floor on which the washing machine is placed; estimating the strength of the floor based on the extracted feature amount; determining it based on the estimated strength whether the operation mode has to be changed from the first operation mode; and outputting an instruction to the washing machine when it is determined that the operation mode has to be changed from the first operation mode, in order to change the operation mode from the first operation mode to a second operation mode different from the first operation mode.

According to the aforementioned configuration, since the vibration information indicative of vibrations of the washing tub of the washing machine is used or determining whether the operation mode has to be changed from the first operation mode to the second operation mode, output from a vibration sensor attached to the washing tub is used for the determination process. Accordingly, an additional vibration sensor attached to a housing is not required for the determination process.

Since an instruction to change the operation mode to the second operation mode is output to the washing machine when it is determined on the basis of the estimated strength of the floor in the determination process that the operation mode has to be changed from the first operation mode to the second operation mode, the washing machine operates in the second operation mode different from the first operation mode in which large vibrations have happened. Accordingly, there are reduced vibrations under operation of the washing machine.

With regard to the aforementioned configuration, the obtaining the vibration, information may include obtaining vibration information at a predetermined frequency, the vibration information being indicative of a vibration component in at least one direction.

According to the aforementioned configuration, since vibration information indicative of a vibration component in at least one direction is obtained at a predetermined frequency, time series data of the vibration component in at least one direction may be obtained. Apart of the time series data may be used for calculation of a feature amount on the basis of time data of the time series data. In this case, there is a reduced calculation load for the determination process.

With regard to the aforementioned configuration, the second operation mode may be different from the first operation mode in a change pattern of a rotation speed of the washing tub.

If there are large vibrations under resonance of the washing machine operating in the first operation mode with the floor, large vibrations may make a user feel uncomfortable. According to the aforementioned configuration, since the second operation mode is different from the first operation mode in a change pattern of a rotation speed of the washing, tub, there is reduced resonance between the washing machine and the floor.

With regard to the aforementioned configuration, the operation mode of the washing machine may include an acceleration mode in which the washing tub accelerates toward a predetermined target number of rotations. The outputting the instruction to the washing machine may include outputting an instruction to change the target number of rotations from a first target value to a second target value different from the first target value.

If the washing machine resonates with the floor to cause large vibrations when the target number of rotations of the washing tub is the first target value, the user may feel uncomfortable because of the large vibrations. According to, the aforementioned configuration, since an instruction is output to change the number of rotations to the second target value different from the first target value, there is reduced resonance between the washing machine and the floor.

With regard to the aforementioned configuration, the operation mode of the washing machine may include an acceleration mode in which the washing tub accelerates toward a predetermined target number of rotations. The outputting the instruction to the washing machine may include outputting an instruction to shorten or extend a period in which the target number of rotations is set to a predetermined target value.

If the washing machine resonates with the floor when the number of rotations of the washing tub is a predetermined value, the user may feel uncomfortable because of large vibrations. According to the aforementioned configuration, since the instruction is output to shorten or extend a period in which the target number of rotations is set to a predetermined target value, a change pattern of a rotation speed of the washing tub is changed to reduce the resonance between the washing machine and the floor.

With regard to the aforementioned configuration, the extracting the feature amount from the vibration information may include extracting at least one of a minimum value, a maximum value, an average value and a standard deviation of vibration accelerations.

According to the aforementioned configuration, a minimum value, a maximum value, an average value and a standard deviation of vibration accelerations are calculated by simple calculation processes. In short, the extraction of the predetermined feature amount does not need no high calculation load, the feature amount having correlation with a strength of the floor on which the washing machine is placed.

With regard to aforementioned configuration, the estimating the strength of the floor from the extracted feature amount may include applying the extracted feature amount to a correlation model mated by a predetermined machine learning algorithm.

In general, a machine learning algorithm is useful for creating an accurate correlation model According to the aforementioned configuration, since the strength of the floor is estimated on the basis of the correlation model created by the predetermined machine learning algorithm, estimation of a floor strength and the determination process after the estimation may be conducted accurately.

With regard to the aforementioned configuration, the estimating the strength of the floor from the extracted feature amount may include applying the extracted feature amount to a correlation model, which classifies correlations between the feature amount and the strength into placement conditions, to estimate which of the placement conditions the extracted feature amount belongs to.

According to the aforementioned configuration, since it is determined whether a change of the operation mode from the first operation mode is required, on the basis of a determination result about which of the placement conditions the extracted feature amount belongs to, it is only necessary to prepare only operation modes as many as placement conditions classified by the correlation model. Since it is necessary only to identify a condition among the placement conditions so that a placement condition under which the washing machine is currently placed belongs to the identified condition, too many placement conditions are not required. Accordingly, since too many operation modes are not also required, there is a simplified determination process.

With regard to the aforementioned configuration, the control method may further include notifying a user of the washing machine that a change of the operation mode is required when it is determined that the operation mode has to be changed from the first operation mode; and receiving acceptance or refusal of the change of the operation mode from the user.

According to the aforementioned configuration, the user aware of necessity of a change of the operation mode may determine whether to change an operation mode.

With regard to the aforementioned configuration, the control method may further include notifying a user that the operation mode has been changed from the first operation mode to the second operations mode.

According to the aforementioned configuration, since the user may know that the operation mode has been changed from the first operation mode to the second operation mode, it is possible to confirm execution of the process for a reduction in vibrations.

With regard to the aforementioned configuration, the control method may further include returning the operation mode to the first operation mode when it is requested to return the operation mode, which has been changed to the second operation mode, to the first operation mode.

When there is a change in a placed position of the washing machine, the washing machine operating in the second operation mode may resonate with a floor at a newly placed position to cause large vibrations. According to the aforementioned configuration, since the operation mode is returned to the first mode, the large vibrations are eliminated.

With regard to the aforementioned configuration, the estimating the strength of the floor from the extracted feature amount may include applying the extracted feature amount to a correlation model created based on log information in which the vibrations are recorded accumulatively in time series.

According to the aforementioned configuration, since the correlation model for use in the estimation of a floor strength is created on the basis of log information in which the vibrations are recorded accumulatively in time series, the floor strength is estimated on the basis of actual vibrations resultant from operation of the washing machine. Accordingly, the floor strength may be estimated accurately.

With regard to the aforementioned configuration, the estimating the strength of the floor from the extracted feature amount may include applying the extracted feature amount to a correlation model created based on log information in which the vibrations of the washing machine are recorded accumulatively in time series, the washing machine operating under an operation environment in which there is a load no more than a predetermined threshold load.

According to the aforementioned configuration, since the log information is obtained from the washing machine operating under an operation environment in which there is a load no more than a predetermined threshold load, effects of a load of the washing machine on the vibrations is eliminated from the correlation model for use in the determination process. Accordingly, the correlation model may represent an accurate relationship between operation of the washing machine and the floor.

The control device according to another aspect of the aforementioned embodiment controls an operation mode of a washing machine under communication with the washing machine. The control, device includes an acquisition portion configured to obtain vibration information indicative of vibrations of a washing tub of the washing machine operating under a predetermined first operation mode as the operation mode; an extractor configured to extract a predetermined feature amount from the vibration information, the feature amount having correlation with a strength of a floor on which the washing machine is placed; an estimation portion configured to estimate the strength of the floor based on the extracted feature amount; a determination portion configured to, determine it based on the estimated strength whether the operation, mode has to be changed from the first operation mode; and an output portion configured to output an instruction to the washing machine when it is determined that the operation mode has to be changed from the first operation mode, in, order to change the operation mode from the first operation mode to a second operation mode different from the first operation mode.

According to the aforementioned configuration, since the acquisition portion obtains vibration information indicative of vibration of the washing tub of the washing machine, output from a vibration sensor attached to the washing machine is used as the vibration information. Accordingly, an additional vibration sensor attached to a housing is not required for the determination process.

Since the output portion outputs an instruction to the washing machine in order to change the operation mode to the second operation mode when the determination portion determines that the operation mode has to be changed from the first operation mode to the second operation mode on the basis of the floor strength, the washing machine operates under the second operation mode different from the first operation mode in which large vibrations have happened. Accordingly, there are reduced vibrations caused by operation of the washing machine.

A non-transitory recording medium according to yet another aspect of the aforementioned embodiment is used for recording a program causing a computer to operate as a control device, the control device configured to control an operation mode of a washing machine under communication with the washing machine. The program causes the computer to: (i) obtain vibration information indicative of vibrations of the washing machine operating under a predetermined first operation mode as the operation mode; (ii) extract a predetermined feature amount from the vibration information, the feature amount having correlation with a strength of a floor on which the washing machine is placed; (iii) estimate the strength of the floor based on the extracted feature amount; (iv) determine it based on the estimated strength whether the operation mode has to be changed from the first operation mode; and (v) output an instruction to the washing machine when it is determined that the operation mode has to be changed from the first operation mode, in order to change the operation mode from the first operation mode to a second operation mode different from the first operation mode.

According to the aforementioned configuration, since vibration information indicative of vibration of the washing tub of the washing machine is used for determining whether the operation mode has to be changed from the first operation mode to the second operation mode output from a vibration sensor attached to the washing tub is used for the determination process. Accordingly, an additional vibration sensor attached to a housing is not required for the determination process.

Since an instruction to change the operation mode to the second operation mode is output to the washing machine when it is determined on the basis of a floor strength estimated in the determination process that the operation mode has to be changed from the first operation mode to the second operation mode, the washing machine operates under the second operation mode different from the first operation mode in which large vibrations have happened. Accordingly, there are reduced vibrations resultant from operation of the washing machine.

The principle of the present embodiment is suitably used in various environments under which a washing machine is used.

This application is based on Japanese Patent application No. 2018-040664 filed in Japan Patent Office on Mar. 7, 2018, the contents of which are hereby incorporated by reference.

Although the present invention has been fully described by way of example with reference to the accompanying drawings, it is to be understood that various changes and modifications will be apparent to those skilled in the art. Therefore, unless otherwise such changes and modifications depart from the scope of the present invention hereinafter defined, they should be construed as being included therein.

The invention claimed is:

1. A control method of controlling a washing machine, the control method comprising:

obtaining vibration information indicative of vibration accelerations detected by a vibration detector which is mounted on a washing tub of the washing machine operating under a predetermined first operation mode;

extracting a part of the vibration information by excluding vibration accelerations which have been detected during the washing tub rotation at a constant speed;

calculating (i) an average of the vibration accelerations of the extracted vibration information and (ii) a standard deviation of the vibration accelerations of the extracted vibration information;

estimating a strength of a floor based on (i) the calculated average of the vibration accelerations of the extracted vibration information and (ii) the calculated standard deviation of the vibration accelerations of the extracted vibration information, the washing machine being placed on the floor;

determining, based on the estimated strength of the floor, whether the first operation mode should be changed to a second operation mode which is different from the first operation mode; and when it is determined that the first operation mode should be changed to the second operation mode, outputting an instruction to the washing machine causing the washing machine to change from operating under the first operation mode to operating under the second operation mode, the change from operating under the first operation mode to operating under the second operation mode causing a change in operation of the washing tub of the washing machine.

2. The control method according to claim 1, wherein the obtaining the vibration information includes obtaining vibration information at a predetermined frequency, the vibration information being indicative of vibration accelerations in at least one direction.

3. The control method according to claim 1, wherein the washing machine is configured to operate under an acceleration mode in which the washing tub accelerates toward a predetermined target speed of the washing tub in number of rotations per time, and wherein the outputting the instruction to the washing machine includes outputting an instruction to change the target speed of the washing tub in the number of rotations per time from a first target value to a second target value different from the first target value.

4. The control method according to claim 1, wherein the washing machine is configured to operate under an acceleration mode in which the washing tub accelerates toward a predetermined target speed of the washing tube in number of rotations per time, and wherein the outputting the instruction to the washing machine includes outputting an instruction to shorten or extend a period in which the target speed of the washing tub in the number of rotations per time is set to a predetermined target value.

5. The control method according to claim 1, further comprising:

extracting a minimum value of the vibration accelerations of the extracted vibration information and a maximum value of the vibration accelerations of the extracted vibration information, wherein the estimating the strength of the floor includes estimating the strength of the floor based on the calculated average of the vibration accelerations of the extracted vibration information, the calculated standard deviation of the vibration accelerations of the extracted vibration information, the extracted minimum value of the vibration accelerations of the extracted vibration information, and the extracted maximum value of the vibration accelerations of the extracted vibration information.

6. The control method according to claim 1, wherein the estimating the strength of the floor includes applying the calculated average of the vibration accelerations of the extracted vibration information and the calculated standard deviation of the vibration accelerations of the extracted vibration information to a correlation model created by a predetermined machine learning algorithm.

7. The control method according to claim 1, wherein the estimating the strength of the floor includes:

applying the calculated average of the vibration accelerations of the extracted vibration information and the calculated standard deviation of the vibration accelerations of the extracted vibration information to a correlation model configured to execute a numerical operation by using the calculated average of the vibration accelerations of the extracted vibration information and the calculated standard deviation of the vibration accelerations of the extracted vibration information; and determining which one of a plurality of predetermined categories that a result of numerical operation belongs to, each of the predetermined categories being associated with results of numerical operations.

8. The control method according to claim 1, further comprising:

notifying a user of the washing machine that a change from the first operation mode is required when it is determined that the first operation mode should be changed to the second operation mode; and receiving acceptance or refusal from the user about the change from the first operation mode to the second operation mode.

9. The control method according to claim 1, further comprising notifying a user that the first operation mode has been changed to the second operation mode.

10. The control method according to claim 1, further comprising:

after outputting the instruction to the washing machine causing the washing machine to change from operating under the first operation mode to operating under the second operation mode, cause the washing machine to return to operating under the first operating mode when a change from the second operation mode to the first operation mode is requested.

11. The control method according to claim 1, wherein the estimating the strength of the floor includes applying the calculated average of the vibration accelerations of the extracted vibration information and the calculated standard deviation of the vibration accelerations of the extracted vibration information to a correlation model indicative of correlation between strengths of floors on which the washing machine is to be placed and vibrations of the washing tub.

12. A non-transitory recording medium in which a program is recorded to cause a computer to control a washing machine, the program causing the computer to:

obtain vibration information indicative of vibration accelerations detected by a vibration detector which is mounted on a washing tub of the washing machine operating under a predetermined first operation mode;

extracting a part of the vibration information by excluding vibration accelerations which have been detected during the washing tub rotation at a constant speed;

calculating (i) an average of the vibration accelerations of the extracted vibration information and (ii) a standard deviation of the vibration accelerations of the extracted vibration information;

estimating a strength of a floor based on (i) the calculated average of the vibration accelerations of the extracted vibration information and (ii) the calculated standard deviation of the vibration accelerations of the extracted vibration information, the washing machine being placed on the floor;

determine, based on the estimated strength of the floor, whether the first operation mode should be changed to the second operation mode which is different from the first operation mode; and when it is determined that the first operation mode should be changed to the second operation mode, output an instruction to the washing machine causing the washing machine to change from operating under the first operation mode to operating under the second operation mode, the change from operating under the first operation mode to operating under the second operation mode causing a change in operation of the washing tub of the washing machine.

* * * * *